US007017645B2

(12) United States Patent
Johnson et al.

(10) Patent No.: US 7,017,645 B2
(45) Date of Patent: Mar. 28, 2006

(54) THERMOPLASTIC CASTING OF AMORPHOUS ALLOYS

(75) Inventors: William L. Johnson, Pasadena, CA (US); Choongnyun Kim, Northridge, CA (US); Atakan Peker, Aliso Viejo, CA (US)

(73) Assignee: Liquidmetal Technologies, Tampa, FL (US)

( * ) Notice: Subject to any disclaimer, the term of this patent is extended or adjusted under 35 U.S.C. 154(b) by 0 days.

(21) Appl. No.: 10/355,490

(22) Filed: Jan. 31, 2003

(65) Prior Publication Data

US 2003/0222122 A1 Dec. 4, 2003

Related U.S. Application Data

(60) Provisional application No. 60/353,152, filed on Feb. 1, 2002.

(51) Int. Cl.
*B22D 17/10* (2006.01)
*B22D 18/02* (2006.01)
*B22D 11/00* (2006.01)

(52) U.S. Cl. ..... 164/113; 164/463

(58) Field of Classification Search ..... 164/113, 164/312, 463, 423

See application file for complete search history.

(56) References Cited

U.S. PATENT DOCUMENTS

| | | | | |
|---|---|---|---|---|
| 2,190,611 A | | 2/1940 | Sembdner | |
| 4,115,682 A | | 9/1978 | Kavesh et al. | |
| 4,289,009 A | | 9/1981 | Festag et al. | |
| 4,330,027 A | * | 5/1982 | Narasimhan | 164/461 |
| 4,472,955 A | | 9/1984 | Nakamura et al. | |
| 4,529,457 A | | 7/1985 | Kushnick | |
| 4,621,031 A | | 11/1986 | Scruggs | |
| 4,710,235 A | | 12/1987 | Scruggs | |
| 4,854,370 A | | 8/1989 | Nakamura | |
| 4,990,198 A | | 2/1991 | Masumoto et al. | |
| 5,032,196 A | | 7/1991 | Masumoto et al. | |
| 5,035,084 A | | 7/1991 | Towns | |
| 5,035,085 A | | 7/1991 | Mamelson et al. | |
| 5,074,935 A | | 12/1991 | Masumoto et al. | |
| 5,117,894 A | | 6/1992 | Katahira | |
| 5,131,279 A | | 7/1992 | Lang et al. | |
| 5,169,282 A | | 12/1992 | Ueda et al. | |
| 5,209,791 A | | 5/1993 | Masumoto et al. | |
| 5,213,148 A | * | 5/1993 | Masumoto et al. | 164/122 |
| 5,225,004 A | | 7/1993 | O'Handley et al. | |

(Continued)

FOREIGN PATENT DOCUMENTS

EP 0 494 688 B1 7/1992

(Continued)

OTHER PUBLICATIONS

Eshbach et al., "Handbook of Engineering Fundamentals", Third Edition, Wiley Engineering Handbook Series, Section 12, pp. 1114-1119.

(Continued)

*Primary Examiner*—Kuang Y. Lin
(74) *Attorney, Agent, or Firm*—Christie, Parker & Hale, LLP

(57) ABSTRACT

A process and apparatus for thermoplastic casting of a suitable glass forming alloy is provided. The method and apparatus comprising thermoplastically casting the alloy in either a continuous or batch process by maintaining the alloy at a temperature in a thermoplastic zone, which is below a temperature, $T_{nose}$, (where, the resistance to crystallization is minimum) and above the glass transition temperature, Tg, during the shaping or moulding step, followed by a quenching step where the item is cooled to the ambient temperature. A product formed according to the thermoplastic casting process is also provided.

33 Claims, 19 Drawing Sheets

U.S. PATENT DOCUMENTS

| | | | | | |
|---|---|---|---|---|---|
| 5,279,349 | A | * | 1/1994 | Horimura | 164/120 |
| 5,288,344 | A | | 2/1994 | Peker et al. | |
| 5,296,059 | A | | 3/1994 | Masumoto et al. | |
| 5,306,463 | A | | 4/1994 | Horimura | |
| 5,312,495 | A | | 5/1994 | Masumoto et al. | |
| 5,324,368 | A | | 6/1994 | Masumoto et al. | |
| 5,361,826 | A | * | 11/1994 | Yamauchi et al. | 164/457 |
| 5,368,659 | A | | 11/1994 | Peker et al. | |
| 5,390,724 | A | | 2/1995 | Yamauchi et al. | |
| 5,482,580 | A | | 1/1996 | Scruggs et al. | |
| 5,564,994 | A | | 10/1996 | Chang | |
| 5,567,251 | A | | 10/1996 | Peker et al. | |
| 5,589,012 | A | | 12/1996 | Hobby et al. | |
| 5,618,359 | A | | 4/1997 | Lin et al. | |
| 5,711,363 | A | | 1/1998 | Scruggs et al. | |
| 5,735,975 | A | | 4/1998 | Lin et al. | |
| 5,740,854 | A | * | 4/1998 | Inoue et al. | 164/495 |
| 5,797,443 | A | | 8/1998 | Lin et al. | |
| 5,896,642 | A | * | 4/1999 | Peker et al. | 29/522.1 |
| 5,950,704 | A | | 9/1999 | Johnson et al. | |
| 6,027,586 | A | | 2/2000 | Masumoto et al. | |
| 2003/0000601 | A1 | * | 1/2003 | Shimizu et al. | 148/403 |

FOREIGN PATENT DOCUMENTS

| | | | |
|---|---|---|---|
| GB | 2 236 325 | A | 4/1991 |
| JP | 61238423 | A | 10/1986 |
| JP | 2000-343205 | * | 12/2000 |

OTHER PUBLICATIONS

Brochure entitled "ProCAST . . . Not Just for Castings!" Source and date unknown.

Polk et al., "The Effect of Oxygen Additions on the Properties of Amorphous Transition Metal Alloys", Rapidly Quenched Metals III, vol. 1, The Metals Society, 1978, pp. 220-230 (12 pgs).

Kawamura et al., "Full Strength Compacts by Extrusion of Glassy Metal Powder at the Supercooled Liquid State", Appl. Phys. Lett. vol. 67, No. 14, Oct. 2, 1995, pp. 2008-2010.

Kato et al., "Production of Bulk Amorphous $Mg_{85}Y_{10}Cu_5$ Alloy by Extrusion of Atomized Amorphous Powder", Materials Transactions, JIM, vol. 35, No. 2, 1994, pp. 125-129.

Inoue et al., "Mg-Cu-Y Bulk Amorphous Alloys with High Tensile Strength Produced by a High-Pressure Die Casting Method", Materials Transactions, JIM, vol. 33, No. 10, 1992, pp. 937-945.

Lyman, "Forging and Casting", Metals Handbook, 8th Edition, vol. 5, 1970, pp. 285-306.

Amiya et al., "Mechanical Strength and Thermal Stability of Ti-Based Amorphous Alloys with Large Glass-Forming Ability", Materials Science and Engineering, A179/A180, 1994, pp. 692-696.

Inoue et al., "Bulky La-A1-TM (TM=Transition Metal) Amorphous Alloys with High Tensile Strength Produced by a High-Pressure Die Casting Method", Materials Transactions, JIM, vol. 34, No. 4, 1993, pp. 351-358.

Interbike Buyer Official Show Guide; 1996; 3 pgs.

* cited by examiner

*Fit to data*

$\eta(T) = \eta_o \exp[DT_o/(T-T_o)]$ $\eta_o = 4 \times 10^{-5}$ Pas-s

D = 18.5

$T_o$ = 412K $T_{melt}$ $T_g$

THERMOPLASTIC CASTING OF AMORPHOUS ALLOYS

CROSS-REFERENCE TO RELATED APPLICATIONS

This application claims priority under 35 U.S.C. § 119(e) to U.S. Provisional Application No. 60/353,152, filed Feb. 1, 2002, the disclosure of which is incorporated herein by reference.

FIELD OF THE INVENTION

This invention relates to novel methods of casting amorphous alloys, and, more particularly, to methods of thermoplastic casting such amorphous alloys.

BACKGROUND OF THE INVENTION

A large proportion of the metallic alloys in use today are processed by some form of solidification casting. In solidification casting the metallic alloy is melted and cast into a metal or ceramic mold, where it solidifies. The mold is then stripped away and the cast metallic piece is ready for use or for further processing. Commercial-scale casting processes are divided into two principal groups, expendable mold processes and permanent mold processes. In an expendable mold process, the mold is used only one time, such as in investment casting, which involves the use of refractory shells as molds. In a permanent mold process, metallic or graphite molds are repeatedly used for multiple castings.

Permanent molding processes can be classified by the type of mechanism used to fill the mold. In one form of permanent mold casting, the molten metal is fed to the mold under the force of gravity or a relatively small metal pressure head. In another form, referred to as die casting, the molten metal is supplied to the die-casting mold under a relatively high pressure, typically 500 psi (pounds per square inch) or more, such as with the aid of a hydraulic piston. In such a process the molten metal is forced into the shape defined by the interior surface of the mold. The shape can usually be more complex than that easily attained using permanent mold casting because the metal can be forced into the complexly shaped features of the die-casting mold, such as deep recesses. The die casting mold is usually a split-mold design such that the mold halves can be separated to expose the solidified article and facilitate the extraction of the solidified article from the mold.

High-speed die-casting machines have been developed to reduce production costs, with the result that many of the small cast metallic parts found in consumer and industrial goods are produced by die-casting. In such die-casting machines a charge or "shot" of molten metal is heated above its melting point and forced into the closed die under a piston pressure of at least several thousand pounds per square inch. The metal quickly solidifies, the die halves are opened, and the part is ejected. Commercial machines may employ multiple die sets such that additional parts can be cast while the previously cast parts are cooling and being removed from the die and the die is prepared with a lubricant coating for its next use.

Although these methods have proven effective in making parts at relatively high processing speeds, there are several problems inherent with these techniques. For example, when the metal is forced into the die-casting mold in commercial die-casting machinery it first solidifies against the opposing mold walls. As a result, defects arising from turbulent flow at the surface of the die-cast article are formed. Also, there is a tendency to form a shrinkage cavity or porosity along the centerline of the die-casting mold when unsolidified liquid is trapped inside a solid shell of solidified metal.

In addition, because the metal is fed into the die under high pressure and at high velocities, the molten metal is in a turbulent state. Indeed, in many applications an atomized "spray" of metal is used to fill the dies. This turbulent action causes discontinuities, not only at the surface of the cast part, but also in the center of the cast part from gas being trapped in the solidifying metal—creating porosity. Atomization of the liquid metal also creates internal boundaries within the part weakening the finished article. Accordingly, on the whole die-casting produces rather porous parts of relatively low soundness, and therefore having relatively poor mechanical properties. As a result, die-cast parts are not usually used for applications requiring high mechanical strengths and performance.

Amorphous alloys (glass forming alloys or metallic glass alloys) differ from conventional crystalline alloys in their atomic structure, which lacks the typical long-range ordered patterns of the atomic structure of conventional crystalline alloys. Amorphous alloys are generally processed and formed by cooling a molten alloy from above the melting temperature of the crystalline phase (or the thermodynamic melting temperature) to below the "glass transition temperature" of the amorphous phase at "sufficiently fast" cooling rates, such that the nucleation and growth of alloy crystals is avoided. As such, the processing methods for amorphous alloys have always been concerned with quantifying the "sufficiently fast cooling rate", which is also referred to as "critical cooling rate", to ensure formation of the amorphous phase.

The "critical cooling rates" for early amorphous alloys were extremely high, on the order of $10^{6\circ}$ C./sec. As such, conventional casting processes were not suitable for such high cooling rates, and special casting processes such as melt spinning and planar flow casting were developed. Due to the extremely short time available (on the order of $10^{-3}$ seconds or less) for heat extraction from the molten alloy, early amorphous alloys were also limited in size in at least one dimension. For example, only very thin foils and ribbons (order of 25 microns in thickness) were successfully produced using these conventional techniques.

Because the critical cooling rate requirements for these amorphous alloys severely limits the size of parts made from amorphous alloys, the use of early amorphous alloys in bulk objects and articles has been limited despite the many superior properties of the amorphous alloy materials. Over the years it has been determined that the "critical cooling rate" is a very strong function of the chemical composition of amorphous alloys. (Herein, the term "composition" includes incidental impurities such as oxygen in the amorphous alloy). Accordingly, new alloy compositions with much lower critical cooling rates have been sought.

In the last decade, several bulk-solidifying amorphous alloy (bulk-metallic glass or bulk amorphous alloys) systems have been developed. Examples of such alloys are given in U.S. Pat. Nos. 5,288,344; 5,368,659; 5,618,359; and 5,735,975, each of which is incorporated herein by reference. These amorphous alloy systems are characterized by critical cooling rates as low as a few ° C./second, which allows the processing and forming of much larger bulk amorphous phase objects than were previously achievable.

With the availability of low "critical cooling rates" in bulk-solidifying amorphous alloys, it has become possible to apply conventional casting processes to form bulk articles having an amorphous phase. Using "heat flow" equations and simple approximations, the critical cooling rate can be correlated to the "critical casting dimension" of amorphous phase articles, i.e., the maximum castable dimension for articles that retain an amorphous phase. For example, the definition of "critical casting dimension" varies depending on the shape of the amorphous phase article and in turn it becomes the maximum castable diameter for long rods, the maximum castable thickness in plates, and the maximum castable wall thickness in pipes and tubes.

In addition to their lower "critical cooling rate", bulk-solidifying amorphous alloys have several additional properties that make their use in die casting processes particularly advantageous, as described in U.S. Pat. No. 5,711,363, which is incorporated herein by reference. For example, bulk-solidifying amorphous alloys are often found adjacent to deep eutectic compositions so that the temperatures involved in die-casting operations on these materials are relatively low. Additionally, upon cooling from high temperature, such alloys do not undergo a liquid-solid transformation in the conventional sense of alloy solidification. Instead, the bulk-solidifying amorphous alloys become more and more viscous with decreasing temperature, until their viscosity is so high that, for most purposes, they behave as solids (although they are often described as undercooled liquids). Because bulk-solidifying amorphous alloys do not undergo a liquid-solid transformation, they do not experience a sudden, discontinuous volume change at a solidification temperature. It is this volume change that leads to most of the centerline shrinkage and porosity in die-cast articles made of conventional alloys. As a result of its absence in bulk-solidifying amorphous alloys, the die-cast articles produced with this material are of higher metallurgical soundness and quality than conventional die-cast articles.

Even though, bulk-solidifying amorphous alloys provide some remedy to the fundamental deficiencies of solidification casting, and particularly to the die-casting and permanent mold casting processes, as discussed above, there are still issues which need to be addressed. First, there is a need to make still larger bulk objects, and articles of bulk-solidifying amorphous alloys, and also a need to make these articles from a broader range of alloy compositions. Presently available bulk solidifying amorphous alloys with large critical casting dimensions are limited to a few groups of alloy compositions based on metals not necessarily optimized from either an engineering or cost perspective. Accordingly, there is a pressing need to overcome these compositional limitations.

In the prior art of processing and forming bulk-solidifying amorphous alloys, the cooling of the molten alloy from above the thermodynamic melting temperature to below the glass transition temperature has been realized using a single-step monotonous cooling operation. For example, metallic molds (made of copper, steel, tungsten, molybdenum, composites thereof, or other high conductivity materials) at ambient temperatures are utilized to facilitate and expedite heat extraction from the molten alloy. Accordingly, in the prior art, the correlation between the critical cooling rate and the "critical casting dimension" is based on a single-step monotonous cooling process. As such, prior art processes put severe limitations on the "critical casting dimension", and are not suitable for forming larger bulk objects and articles of a broader range of bulk-solidifying amorphous alloys.

The single-step cooling operation of bulk-solidifying amorphous alloys also initiates the rapid formation of a solid shell against the opposing mold walls, due to the rapid temperature decrease from above the melting temperature down to below glass transition temperature. This solidification shell impedes the flow of molten alloy adjacent to the mold surface and limits the replication of very fine die-features. As a result, it is often necessary to inject the molten alloy into the dies at high-speed, and under high-pressure, to ensure sufficient alloy material is introduced into the die prior to the solidification of the alloy, particularly in the manufacture of complex and high-precision parts. Because the metal is fed into the die under high pressure and at high velocities, such as in high-pressure die-casting operation, the molten metal is in a turbulent state. Indeed, in many applications an atomized "spray" of molten bulk-solidifying amorphous metal is used to fill the dies. As in the high-pressure die-casting processes with conventional materials, this turbulent action causes discontinuities, not only at the surface of the cast part, but also in the center of the part from gas being trapped in the solidifying metal--creating porosity. Atomization of the liquid metal also creates internal boundaries within the part weakening the finished article. Finally, the turbulent flow creates shear bands and serrations in the flow pattern.

Accordingly, there is needed to find an improved approach to the casting of amorphous metals which permits the rapid production, of large, high-quality, high-precision, complex parts.

SUMMARY OF THE INVENTION

The invention is directed to both a thermoplastic casting process and to an apparatus for implementing thermoplastic casting of suitable glass forming alloys. Also included in the invention are articles of amorphous alloy made by the inventive thermoplastic casting process.

In one embodiment, the invention is directed to a method and apparatus for thermoplastically casting a bulk-solidifying amorphous alloy in a continuous process by initially cooling the alloy (Step A) to an intermediate thermoplastic forming temperature; and then thermalizing and maintaining the alloy temperature at a near constant and uniform spatial profile in a molding step (Step B), while simultaneously shaping and forming a product. Step B is then followed by a final quenching step (Step C), where the final cast product is cooled to ambient temperature. In such an embodiment, the thermoplastic forming temperature is chosen to fall in a thermoplastic zone lying above the glass transition temperature, whereby the rheological properties of the liquid can be exploited to carry out alloy shaping and forming using practical pressures and on time scales sufficiently short to avoid alloy crystallization.

In another embodiment, the thermoplastic casting uses a batch process.

In still another embodiment, the thermoplastic forming temperature used in Step B lies above the glass transition but below a crystallization temperature, $T_{nose}$, where, $T_{nose}$ is the temperature where crystallization is most rapid and occurs in the shortest time scale. Below $T_{nose}$, the time available before crystallization, $t_x(T)$, depends on temperature and steadily increases with decreasing temperature. In such an embodiment, a suitable choice of thermoplastic forming temperature allows for a sufficient molding time by shifting the onset of crystallization to times much longer than the minimum crystallization time, $T_{nose}$.

In yet another embodiment, the alloy is shaped in a heated mould or tool die. In such an embodiment, the mould or tool die is preferably kept within 150° C. of the glass transition temperature of the alloy. In such an embodiment, the liquid alloy equilibrates with the mould or tool die and achieves a nearly uniform temperature equal to that of the mould or tool die. In one exemplary embodiment, the mould or die is temperature controlled through a feedback control system with both active cooling, such as a gas cooling system, and active heating used to maintain a constant die temperature.

In still yet another embodiment, the temperature of the mould or tool die in Step A is maintained within about 150° C. of Tg, and in Step B the temperature of the mould or tool die is maintained within about 150° C. of Tg. In one preferred embodiment of the current invention, the temperature of the mould or tool die in Step A is maintained within about 50° C. of Tg, and in Step B the temperature of the mould or tool die is maintained within about 50° C. of Tg.

In still yet another embodiment, the temperature of the mould or tool die in Step A is maintained above the temperature of the mould or tool die in Step B. In one preferred embodiment of the current invention, the temperature of the mould or tool die in Step B is maintained above the temperature of the mould or tool die in Step A.

In still yet another embodiment, the time spent in Step B is about 5 to 15 times more than the time spent in Step A. In one preferred embodiment, the time spent in Step B is about 10 to 100 times more than the time spent in Step A. In still another preferred embodiment, the time spent in Step B is about 50 to 500 times more than the time spent in Step A.

In still yet another embodiment, the pressure applied to the undercooled melt in Step B is about 5 to 15 times more than the pressure applied to the molten metal in Step A. In yet another embodiment, the pressure applied to the undercooled melt in Step B is about 10 to 100 times more than the pressure applied to the molten metal in Step A. In still another embodiment, the pressure applied to the undercooled melt in Step B is about 50 to 500 times more than the pressure applied to the molten metal in Step A.

In still yet another embodiment, the front end of the undercooled alloy is introduced into a dog-tail tool in Step B, and thereafter this tool is utilized to extract articles of the amorphous alloy continuously.

In still yet another alternative, the molten alloy is maintained in the mould or tool die for a time suitable to achieve a nearly uniform melt temperature equal to that of the mould. In one preferred embodiment the moulding time is maintained between about 3 and 200 seconds, and more preferably the time is between about 10 and 100 seconds.

In still yet another alternative, the rate of flow of liquid alloy through the mould or die tool is maintained at a constant desired velocity or strain rate. In one preferred embodiment the strain rate is help between about 0.1 and 100 $s^{-1}$.

In still yet another alternative embodiment, pressure is used to move the molten alloy through the tool. In such an embodiment, the pressure is preferable held to a value less than about 100 MPa, and more preferably to a value less than about 10 MPa.

In still yet another embodiment, the invention the a mould or die tool is any one of: a permanent or expandable mould, a closed die or closed-cavity die, and an open-cavity die.

In still yet another embodiment, the invention is directed to an extrusion die capable of the continuous production of a two-dimensional amorphous alloy product. In such an embodiment, the two dimensional product may be a sheet, plate, rode, tube, etc. In one preferred embodiment, the product is a sheet or plate having a thickness of up to about 2 cm or a tube having diameter up to about 1 meter and a wall thickness of up to about 5 cm.

In still yet another embodiment, the invention is directed to a die tool for the thermoplastic casting of glass alloys. In one such embodiment the die tool includes an expansion zone where the melt is rapidly cooled past the crystallization zone in a thin restricted cross sectional area, or heat exchanger, which serves to cool the liquid sufficiently rapidly to bring the centerline temperature below the crystallization "nose" at $T_{nose}$, and then the melt is expanded into a portion of the tool of greater thickness. In such an embodiment, the restricted zone preferably has a thickness from about 0.1 to 5 mm, and the expanded zone has a thickness from about 1 mm to 5 cm.

In still yet another alternative embodiment of the invention, the die tool has a roughened entrance surfaced to maintain melt contact and a polished exit surface to permit boundary slip between the die and melt. In one such embodiment, a lubricant is used in the exit to promote this slipping.

In still yet another embodiment, the expansion zone also contains a roughened surface to promote non-slip of the melt. In one such embodiment the expansion zone has a pitch angle of less than about 60 degrees and preferably less than about 40 degrees.

In still yet another embodiment, the die is a split mould die which can be opened to remove the final product.

In still yet another embodiment of the invention, the amorphous alloy is a Zr—Ti alloy, where the sum of the Ti and Zr content is at least about 20 atomic percent of the alloy. In a more preferred embodiment of the invention, the amorphous alloy is a Zr—Ti—Nb—Ni—Cu—Be alloy, where sum of the Ti and Zr content is at least about 40 atomic percent of the alloy. In another more preferred embodiment of the invention, the amorphous alloy composition is a Zr—Ti—Nb—Ni—Cu—Al alloy, where sum of the Ti and Zr content is at least about 40 atomic percent of the alloy.

In still yet another embodiment of the invention, the amorphous alloy is an Fe-base, where Fe content is at least about 40 atomic percent of the alloy.

In still yet another embodiment, the provided amorphous alloy has a critical cooling rate of about 1,000° C./sec or less, and the heat exchanger has a channel width less than about 1.5 mm. In another embodiment of the invention, the provided amorphous alloy has a critical cooling rate of about 100° C./sec or less, and the heat exchanger has a channel width less than about 5.0 mm.

In still yet another embodiment, the invention is directed to a product made by the thermoplastic casting process or apparatus. The product may be any device including: a case for a watch, computer, cell phone, wireless internet device or other electronic product; a medical device such as a knife, scalpel, medical implant, orthodontics, etc.; or a sporting good such as a golf club, ski component, tennis racket, baseball bat, SCUBA component, etc.

In still yet another embodiment, the invention is directed to an amorphous alloy article wherein the critical cooling rate of the amorphous alloy composition is about 1,000° C. or more, and the amorphous alloy article has a minimum dimension of about 2 mm or more, and preferably about 5 mm or more, and still more preferably about 10 mm or more.

In still yet another embodiment, the invention is directed to an amorphous alloy article wherein the critical cooling rate of the amorphous alloy composition is about 100° C. or more, and the amorphous alloy article has a maximum critical casting thickness of dimension of about 6 mm or more, and preferably about 12 mm or more, and still more preferably about 25 mm or more.

In still yet another embodiment, the invention is directed to an amorphous alloy article wherein the critical cooling rate of the amorphous alloy composition is about 10° C. or more, and the amorphous alloy article has a maximum critical casting dimension of about 20 mm or more, and preferably about 50 mm or more, and still more preferably about 100 mm or more.

In still yet another embodiment, the invention is directed to an amorphous alloy article wherein the amorphous alloy article comprises sections with an aspect ratio of about 10 or more, and preferably with an aspect ratio of about 100 or more.

In still yet another embodiment the alloy product has an elastic limit of more than about 1.5%, and more preferably more than about 1.8%, and still more preferably an elastic limit of about 1.8% and a bend ductility of at least about 1.0%.

In still yet another embodiment, the product has functional surface features of less than about 10 microns in scale.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

The present invention is directed to a method and apparatus for processing bulk metallic glasses (amorphous alloys) into unitized, high quality, net shape parts by controlling the temperature, pressure, and strain rate of the liquid amorphous alloy during processing to maintain the amorphous alloy in a quasi-plastic state during shaping, the process being called thermoplastic casting (TPC) herein.

The invention relies on the observation that the time, $t_x(T)$, for undercooled glass forming liquids to undergo crystallization varies systematically and predictably as the liquid is cooled below the melting point of the crystalline solid phase (or phase mixture), $T_m$, down to the glass transition temperature, $T_g$, where the liquid alloy becomes a frozen solid.

Figure 2:
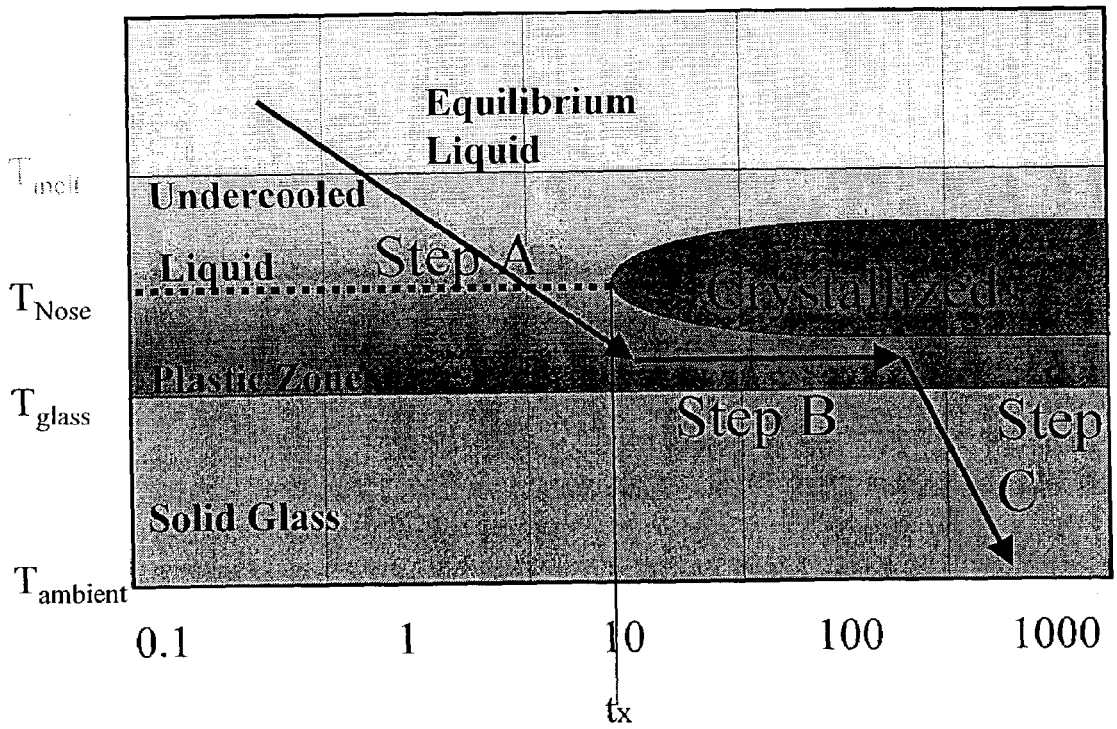
FIG. 2 is a graphical representation of a thermoplastic casting process according to the current invention.

This variation in crystallization time is frequently described in metallurgical literature by the use of time-temperature-crystal transformation diagrams (TTT-diagrams) or by continuous-cooling-crystal transformation diagrams (CCT-diagrams). In the present invention, we will focus on TTT-diagrams. An exemplary schematic TTT-diagram is shown in FIG. 2. As shown, the TTT-diagram is a plot of the time, $t_x(T)$, required to crystallize a prescribed detectable volume fraction (typically ~5%) of the liquid at a given processing temperature, T, in the undercooled liquid (between the $T_m$ and $T_g$). The TTT-diagram is directly measured by melting the liquid (above $T_m$), cooling relatively quickly to the selected temperature, T, in the undercooled range, and then measuring the time elapsed before crystallization begins. Such diagrams have been measured for many glass forming alloys. The crystallization region of such diagrams have a characteristic "C-shape".

Figure 3:
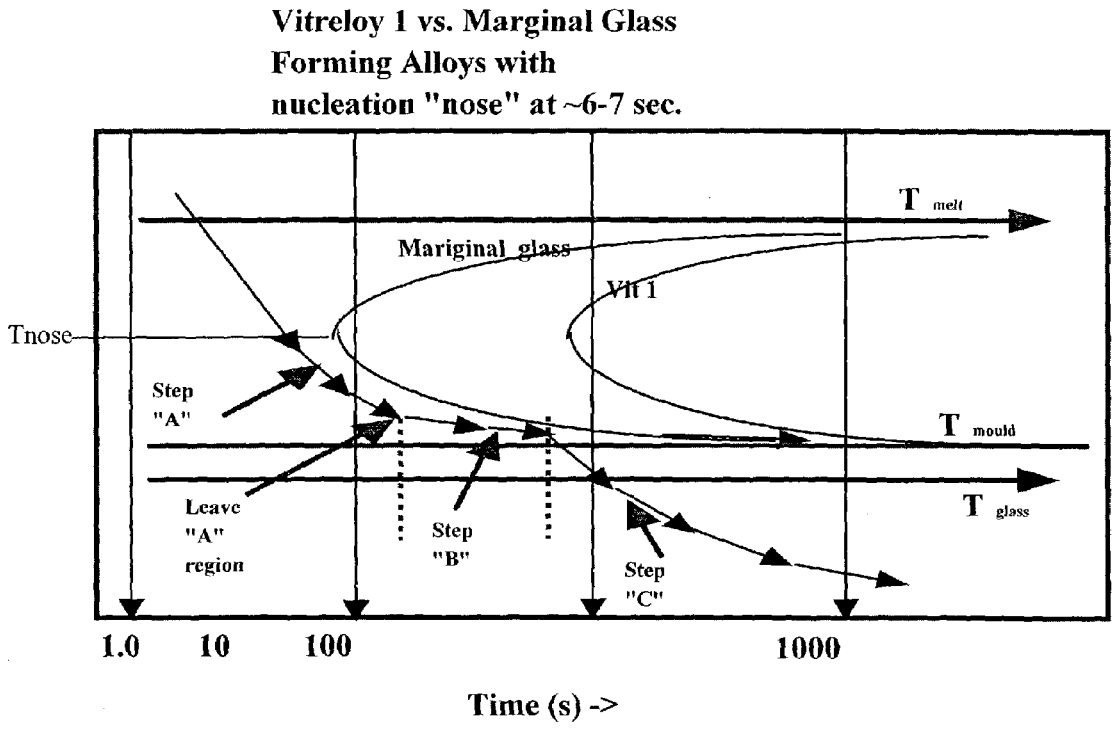
FIG. 3 is a graphical comparison of the crystallization properties of two amorphous alloys. The diagram is referred to as a Time-Temperature-Transformation diagram, and illustrates the time elapsed before the onset of crystallization of the liquid at various undercooling temperatures.

As shown in FIGS. 2 and 3, the time for crystallization exhibits a minimum, which will simple be referred to as $t_x$, at a temperature called $T_{nose}$ lying somewhere midway between $T_g$ and $T_m$. We refer to this minimum time as a single representative parameter of the TTT-diagram given by $t_x(T)$, examples of measurements of $t_x$ will be given. Above or below $T_{nose}$, the time required for crystallization increases rapidly. Thus, once cooled below $T_{nose}$, in a time scale shorter than $t_x$, the time required to crystallize the liquid will increase with decreasing temperature and will generally be much longer than $t_x$, allowing for extended processing for times far beyond $t_x$ without the risk of crystallization.

To process a liquid below $T_{nose}$, one must shape and form the liquid under pressure or stress. The stress or pressure required depends on the Theological properties of the liquid. Bulk metallic glass forming liquids remain quite fluid at temperatures well below $T_{nose}$ and can be formed and shaped with relatively low pressures (e.g. 1–100 MPa) in practical time scales (1–300 seconds). The inventors have surprisingly discovered that this characteristic can be exploited in a solidification casting process, where a multi-step cooling operation is designed by concurrently exploiting the characteristic "C"-shape of the bulk-solidifying amorphous alloys. Measurements of viscosity and Theological properties of bulk glass forming liquids, combined with data from the measured TTT-diagrams, form the basis of practicing the invention. Specifically, The characteristic "C"-shape of TTT-diagrams, combined with the temperature dependence of the viscosity of glass forming liquids permits the design of processes which use a multi-step temperature cooling history (as shown schematically in FIGS. 2 and 3) to sequentially:

(1) Avoid crystallization by cooling relatively quickly from above $T_m$ to a temperature, T, below $T_{nose}$ thereby avoiding crystallization during this initial cooling step;

(2) Carry out thermoplastic forming and shaping operations at the thermoplastic forming temperature, T, between $T_g$ and $T_{nose}$ using modest pressures to form the liquid in convenient time scales which avoid crystallization of the alloy at the thermoplastic forming temperature. The process is carried out in a time scale shorter than $t_x(T)$; and (3) Recover a substantially amorphous product by using a final cooling step, which brings the product from the thermoplastic forming temperature to ambient temperature.

The invention uses the detailed form of the TTT (Time-temperature-Transformation) diagrams. This form depends on the specific alloy to be processed. Further, the TTT-diagrams may show substantial variations even within alloys deemed to have the same or similar "critical cooling rates" or critical casting dimensions. More particularly, since the initial cooling step is designed to avoid crystallization at the TTT-diagram nose, once this step is completed the forming operation is no longer limited by the minimum time to nucleation. As a result of this, the multiple step operations of this invention can be used to overcome the "critical casting dimension" limitation of a single step process. This results in the ability to cast thicker sections of a given amorphous alloy than would be permitted by a single step casting operation. In other words, the process of this invention allows one to overcome previously perceived critical dimension limits that arise when one casts to an ambient temperature mold in a single step monotonous cooling process. This multi-step process allows one to expand critical casting dimensions for a given glass-forming alloy. It can be used to enhance processability of otherwise marginal glass forming liquids and significantly expands the range of amorphous metals that can be used in practical applications.

Further, the invention also recognizes that by controlling the pressure and/or strain-rate profile at certain temperature ranges, amorphous alloys can be formed and shaped into higher quality articles having much higher aspect-ratios with closer tolerances and far more detailed replication of mold features. In sum, the process allows production of very high quality, precision substantially amorphous net shape components having exceptional soundness, integrity, and mechanical properties. Herein "substantially amorphous" is defined as a final as-cast article having at least 50% by volume of the article having an amorphous atomic structure, and preferably at least 90% by volume of the article having an amorphous atomic structure, and most preferably at least 99% by volume of the article having an amorphous atomic structure. The detailed basis for these conclusions will become clear through the use of specific examples and preferred embodiments of the process presented below.

Figure 1:
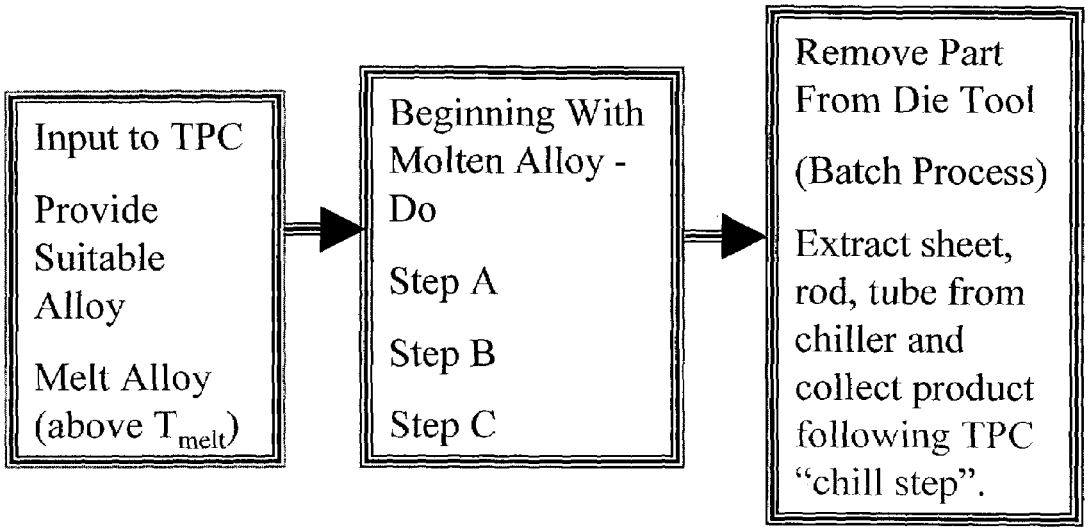
FIG. 1 is a flow chart of an embodiment of a thermoplastic casting process according to the current invention.

One embodiment of the basic method of the current invention is shown in a flow-chart in FIG. 1, and graphically in FIG. 2. In a first step, a suitable bulk-solidifying alloy is first melted above its thermodynamic melting temperature ($T_m$) forming a molten supply of amorphous alloy. Although specific examples of amorphous alloys will be discussed in the current application, it should be understood that any bulk-solidifying or bulk-metallic glass alloy which may be stabilized in a thermoplastic forming zone upon cooling between the crystallization nose, $T_{nose}$, and the glass transition temperature, $T_g$, and maintained in this thermoplastic state for sufficient time to process the alloy, may be utilized in the current invention. Exemplary embodiments of such bulk-solidifying amorphous alloys have been described, for example, in U.S. Pat. Nos. 5,288,344 and 5,368,659, whose disclosures are incorporated herein by reference.

Following initial heating and melting, the molten alloy is introduced into the casting machine and processed in three steps. In Step A, the temperature of the molten metal is rapidly quenched until the temperature of alloy is lower than the alloy's critical crystallization temperature, $T_{nose}$, but higher than the alloy's glass transition temperature, $T_g$. As discussed above, this temperature range is referred to as the "thermoplastic zone" of the alloy. Examples of the "nose" in the TTT-diagram (see FIGS. 2, 3, and 5).

In Step B, the temperature of the alloy is maintained in the thermoplastic zone for a time sufficient to shape the metal as desired. However, this shaping time must be sufficiently short to avoid the onset of crystallization. Again, as discussed above, using the TTT-diagrams (e.g., FIGS. 2, 3, and 5) for a specific material, one can define an available time prior to the onset of crystallization, $t_x(T)$, at thermoplastic temperature, T. The process time must be less than this time.

Finally, in Step C, the temperature of the alloy is quenched from the thermoplastic temperature to a temperature near the ambient temperature such that a fully hardened solid part is produced. After the quenching or final "chill" process, the hardened product is either removed from the die for a batch-processed piece, or extracted in a continuous casting process.

FIGS. 2 and 3 schematically show exemplary Time-Temperature-Transformation diagrams for crystallization (TTT-diagrams) of a hypothetical liquid alloy during the thermoplastic casting process. In both these figures, the TTT-diagram is overlaid with the method steps described above. The TTT-diagrams show the well-known crystallization behavior of the liquid alloy when it is undercooled below its equilibrium melting point $T_{melt}$. As discussed briefly above, it is well known that if the temperature of an amorphous alloy is dropped below the melting temperature the alloy will ultimately crystallize if not quenched to the glass transition temperature before the elapsed time exceeds a critical value, $t_x(T)$. This critical value is given by the TTT-diagram and depends on the undercooled temperature. However, there is a process window or thermoplastic window below the temperature, $T_{nose}$, and above the solid glass region and in the process according to the present invention, the alloy is initially cooled sufficiently rapidly from above the melting point to this thermoplastic temperature (below $T_{nose}$) to bypass the nose region of the material's TTT-diagram ($T_{nose}$, which represents the temperature for which the minimum time to crystallization of the alloy will occur) and avoid crystallization.

For a given alloy strain rate or injection velocity, there is also a minimum thermoplastic processing temperature required to avoid instabilities in the flow pattern such as shear bands. In a preferred embodiment of the present invention, the thermoplastic process temperature is chosen to lie above this minimum temperature for flow instability. Thus, Step A, comprises: (1) injecting the molten alloy into a mould tool held at a thermoplastic process temperature; (2) ensuring by suitable choice of the die tool, that the melt is everywhere (from surface to centerline) cooled sufficiently rapidly to avoid crystallization as it is cooled past the crystallization "nose" at $T_{nose}$; and (3) choosing a final thermoplastic process temperature high enough to avoid melt flow instabilities such as shear banding. The alloy is then held at the thermoplastic processing temperature for Step B, this step being the molding or shaping step. Step B occurs at a thermoplastic processing temperature and must take place in a time short enough to avoid crystallization at this temperature. As described above, this time, $t_x(T)$, is determined by the TTT-diagram. As shown in FIG. 3, although any bulk metallic glass may be used, the rate at which the liquid temperature must be lowered to avoid crystallization at $T_{nose}$ in Step A, and the length of time the alloy can be maintained in the thermoplastic region and processed in Step B, ultimately depends on the TTT-diagram of the chosen alloy, and specifically on the form of the curve, $t_x(T)$.

For example, a Zr—Ti—Ni—Cu—Be based amorphous alloy made by Liquidmetal Technologies under the tradename Vitreloy-1 can be processed in the thermoplastic temperature range, up to a factor of 10 longer than a marginal amorphous alloy (such as a Cu—Ti—Ni—Zr base Vitreloy-101 also made by Liquidmetal Technologies), and this process time can be expanded even further using other amorphous alloys, such as those made by Liquidmetal Technologies under the tradenames Vitreloy-4 and Vitreloy-1b, for example. Likewise, the cooling rate required in Step A to reach the thermoplastic temperature from the high temperature melt depends on the minimum crystallization time, $t_x$, observed at the crystallization "nose". Thus, the critical cooling history requirements in both Step A and Step B depend on the details of the TTT-diagram of a particular alloy.

Although embodiments utilizing Vitreloy series alloys are discussed above, any bulk-solidifying amorphous alloy may be utilized in the present invention, in a preferred embodiment the bulk-solidifying amorphous alloy has the capability of showing a glass transition in a Differential Scanning Calorimetry (DSC) scan. Further, the feedstock of bulk-solidifying amorphous alloy preferably has a ΔTsc (supercooled liquid region) of more than about 30° C. as determined by DSC measurements at 20° C./min, and preferably a ΔTsc of more than about 60° C., and still most preferably a ΔTsc of about 90° C. or more. One suitable alloy having a ΔTsc of more than about 90° C. is $Zr_{47}Ti_8Ni_{10}Cu_{7.5}Be_{27.5}$. U.S. Pat. Nos. 5,288,344; 5,368,659; 5,618,359; 5,032,196; and 5,735,975 (each of which are incorporated by reference herein) disclose families of such bulk solidifying amorphous alloys with ΔTsc of about 30° C. or more. Herein, ΔTsc is defined as the difference of $T_x$ (the onset of crystallization) and $T_g$ (the onset of glass transition) as determined from standard DSC scans at 20° C./min.

One such family of suitable bulk solidifying amorphous alloys may be described in general terms as $(Zr,Ti)_a(Ni,Cu,Fe)_b(Be,Al,Si,B)_c$, where a is in the range of from about 30% to 75% of the total composition in atomic percentage, b is in the range of from about 5% to 60% of the total composition in atomic percentage, and c is in the range of from about 0% to 50% in total composition in atomic percentage.

Another set of bulk-solidifying amorphous alloys are ferrous metals, such as Fe, Ni, and Co based compositions. Examples of such compositions are disclosed in U.S. Pat. No. 6,325,868; Japanese Patent Application No. 200012677 (Publ. No. 20001303218A), and publications to A. Inoue, et al. (Appl. Phys. Lett., Volume 71, p. 464 (1997)) and Shen, et al. (Mater. Trans., JIM, Volume 42, p. 2136 (2001)), all of which are incorporated herein by reference. One exemplary composition of such alloys is $Fe_{72}Al_5Ga_2P_{11}Ce_6B_4$. Another exemplary composition of such alloys is $Fe_{72}Al_7Zr_{10}Mo_5W_2B_{15}$. Although these alloy compositions are not processable to the degree of the above-cited Zr-base alloy systems, they can still be processed in thicknesses around 1.0 mm or more, sufficient to be utilized in the current invention.

In general, crystalline precipitates in bulk amorphous alloys are highly detrimental to their properties, especially to the toughness and strength, and as such generally preferred to a minimum volume fraction possible. However, there are cases in which, ductile crystalline phases precipitate in-situ during the processing of bulk amorphous alloys, which are indeed beneficial to the properties of bulk amorphous alloys, and particularly to the toughness and ductility of such alloys. Such bulk amorphous alloys comprising such beneficial precipitates are also included in the current invention. One exemplary case is disclosed in (C. C. Hays et. al, Physical Review Letters, Vol. 84, p 2901, 2000).

Further, the selection of preferred compositions of bulk amorphous alloys can be tailored with the aid of the general crystallization behavior of the bulk-solidifying amorphous alloy. For example, in a typical DSC heating scan of bulk solidifying amorphous alloys, crystallization can take one or more steps. The preferred bulk-solidifying amorphous alloys are ones with a single crystallization step in a typical DSC heating scan. However, most of the bulk solidifying amorphous alloys crystallize in more than one step.

Figure 4A:
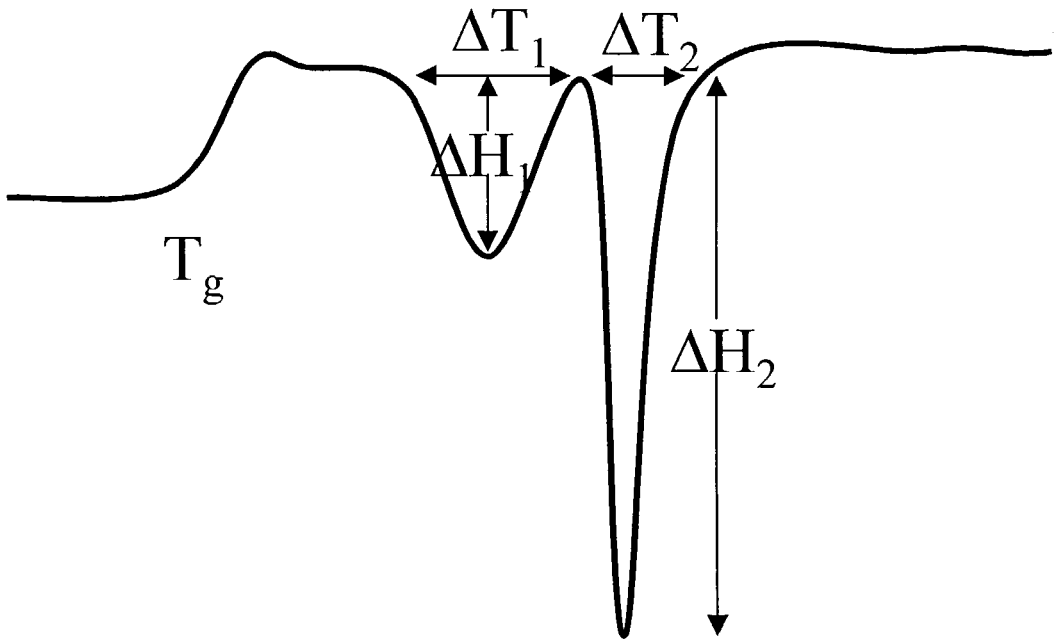
FIG. 4*a* is an exemplary schematic diagram of a DSC scan for a first exemplary amorphous alloy according to the present invention.

Shown schematically in FIG. 4*a* is one type of crystallization behavior of a bulk-solidifying amorphous alloy in a DSC scan. (For the purposes of this disclosure all the DSC heating scans are carried out at the rate of 20° C./min and all the extracted values are from DSC scans at 20° C./min. Other heating rates such as 40° C./min, or 10° C./min can also be utilized while the basic physics of this disclosure still remaining intact.)

In this example, the crystallization occurs over two steps. The first crystallization step occurs over a relatively large temperature range with a relatively slower peak transformation rate, whereas the second crystallization step occurs over a smaller temperature range than the first and at a much faster peak transformation rate than the first. Here ΔT1 and ΔT2 are defined as the temperature ranges over which the first and second crystallization steps respectively occur. ΔT1 and ΔT2 can be calculated by taking the difference between the onset of the crystallization and the "outset" of the crystallization, which are calculated in a similar manner for Tx, by taking the cross section point of the preceding and following trend lines as depicted in FIG. 4*a*. ΔH1 and ΔH2 can also be calculated by calculating the peak heat flow value compared to the baseline heat flow value. (It should be noted that although the absolute values of ΔT1, ΔT2, ΔH1 and ΔH2 depend on the specific DSC set-up, and the size of the test specimens used, the relative scaling (i.e. ΔT1 vs ΔT2) should remain intact).

Figure 4B:
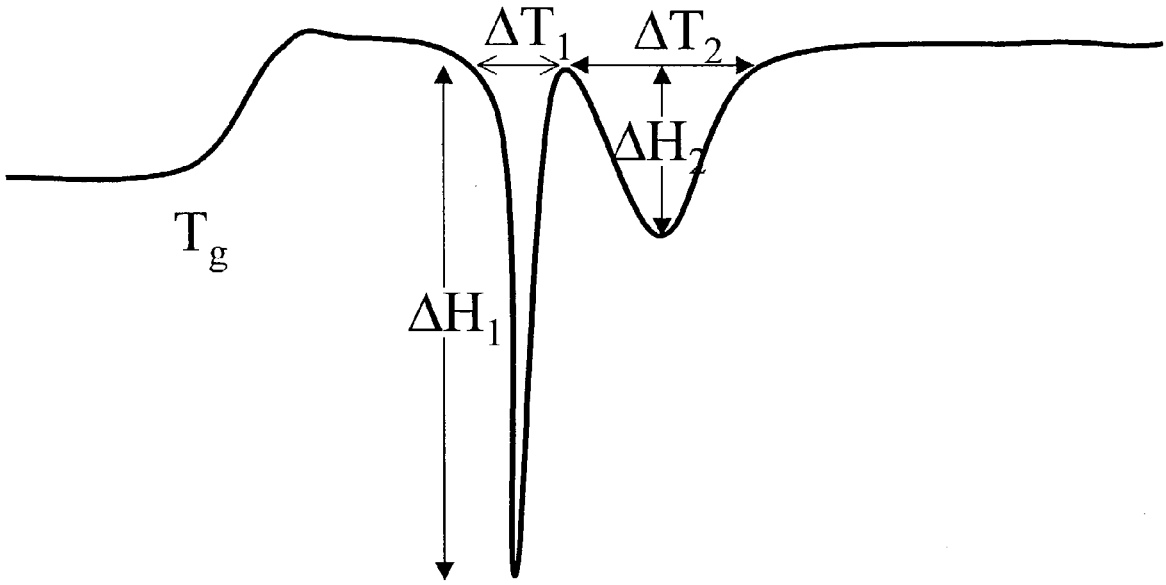
FIG. 4*b* is an exemplary schematic diagram of a DSC scan for a second exemplary amorphous alloy according to the present invention.

Shown schematically in FIG. 4*b* is another type of crystallization behavior of a bulk-solidifying amorphous alloy in a typical DSC scan at the heating rate of 20° C./min. Again the crystallization occurs over two steps, however, in this example the first crystallization step occurs over a relatively small temperature range with a relatively faster peak transformation rate, whereas the second crystallization occurs over a larger temperature range than the first and at a much slower peak transformation rate than the first. Again, here ΔT1, ΔT2, ΔH1 and ΔH2 are defined and calculated as described above.

A sharpness ratio can be defined for each crystallization step by taking the ratio ΔHN/ΔTN. The higher ΔH1/ΔT1 compared to the other ratio, e.g., ΔHN/ΔTN, the more preferred the alloy composition is. Accordingly, from a given family of bulk solidifying amorphous alloys, the preferred composition is the one with the highest ΔH1/ΔT1 compared to the other crystallization steps. For example, a preferred alloy composition has ΔH1/ΔT1>2.0*ΔH2/ΔT2. Still more preferable is ΔH1/ΔT1>4.0*ΔH2/ΔT2. For the two cases described above, the bulk-solidifying amorphous alloy with the second crystallization behavior (as shown in FIG. 4*b*) is the preferred alloy for more aggressive thermoplastic casting, i.e. for operations to produce components with higher aspect ratios and finer features.

Although materials having only two crystallization steps are shown above, the crystallization behavior of some bulk solidifying amorphous alloys can take place in more than two steps. In such cases, the subsequent steps, i.e., ΔT3, ΔT4 . . . ΔHN and ΔH3, ΔH4 . . . ΔHN can also be defined. In such cases, the preferred compositions of bulk amorphous alloys are ones where ΔH1 is the largest of ΔH1, ΔH2, . . . ΔHN.

Figure 12:
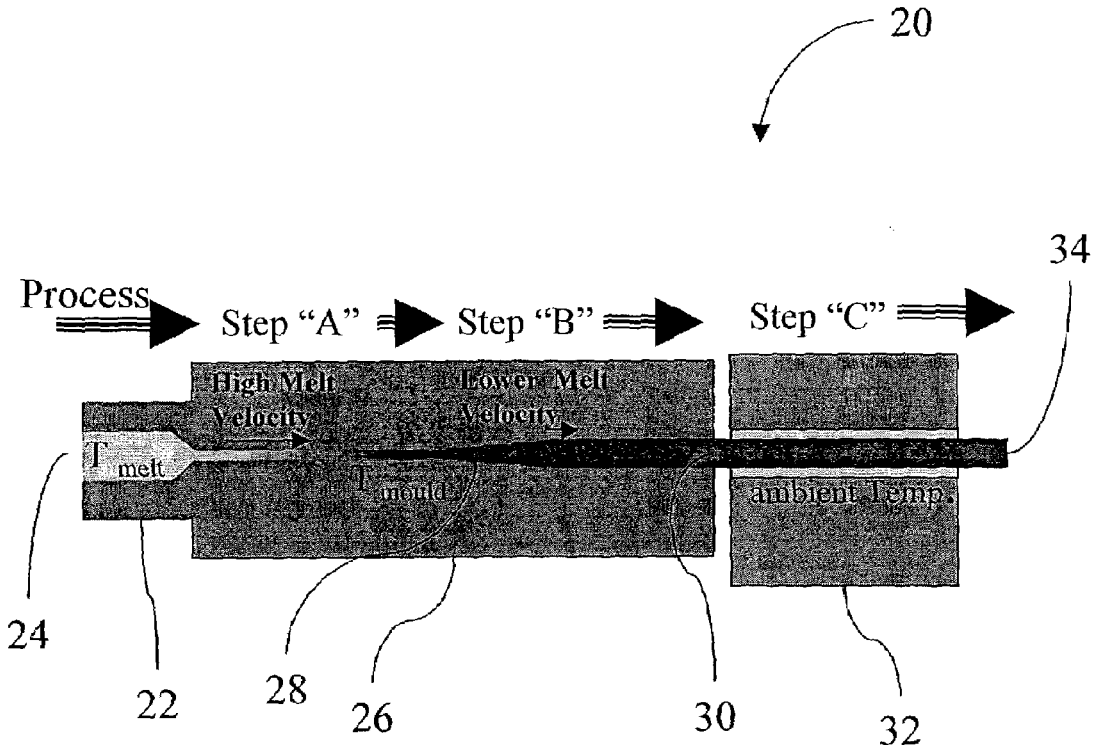
FIG. 12 is a cross-sectional schematic diagram of a thermoplastic casting apparatus according to one embodiment of the current invention.
Figure 14:
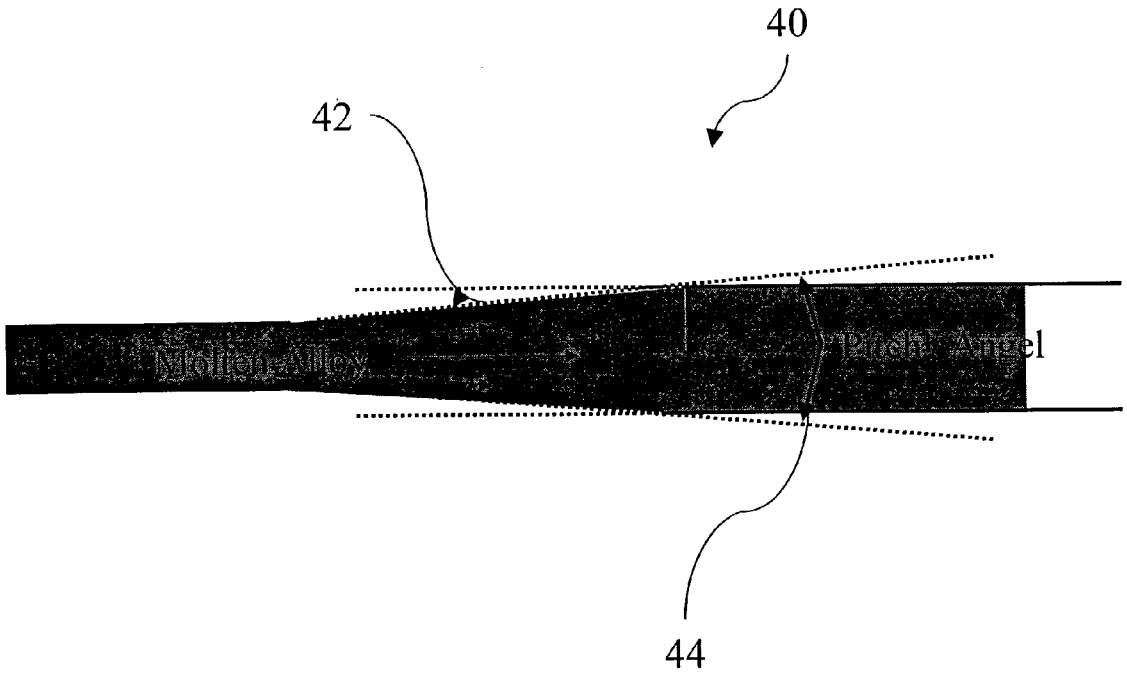
FIG. 14 is a cross-sectional schematic diagram of an expansion section of a thermoplastic casting apparatus according to one embodiment of the current invention.
Figure 17:
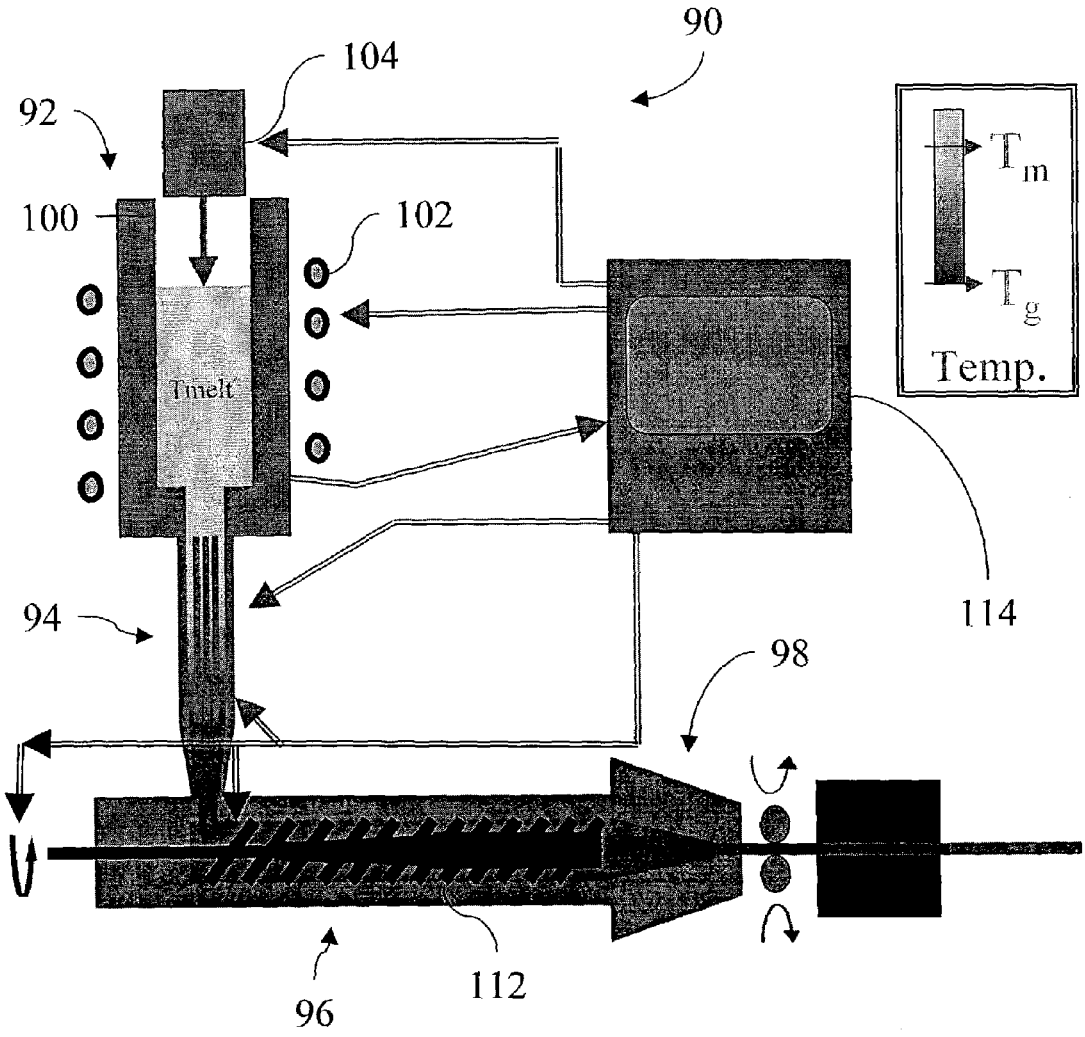
FIG. 17 is a cross-sectional schematic diagram of a thermoplastic casting apparatus according to one embodiment of the current invention.

Accordingly, the range of metallic glass formulations which can be processed is only limited by the processability of the available glass compositions, processability being determined by the time temperature transformation (TTT, i.e., FIGS. 2 and 3) diagram or continuous cooling transformation diagram (CCT) of the material. There is no requirement as to the dimensional limitations for components such as plates, sheets, rods and other parts, which arise from the ability to avoid crystallization. The TPC process can be altered to overcome such dimensional limitations by using expansion sections and heat exchangers (as shown in FIGS. 12, 14, and 17), thereby increasing the critical casting thickness of glass forming alloy plates.

Figure 5:
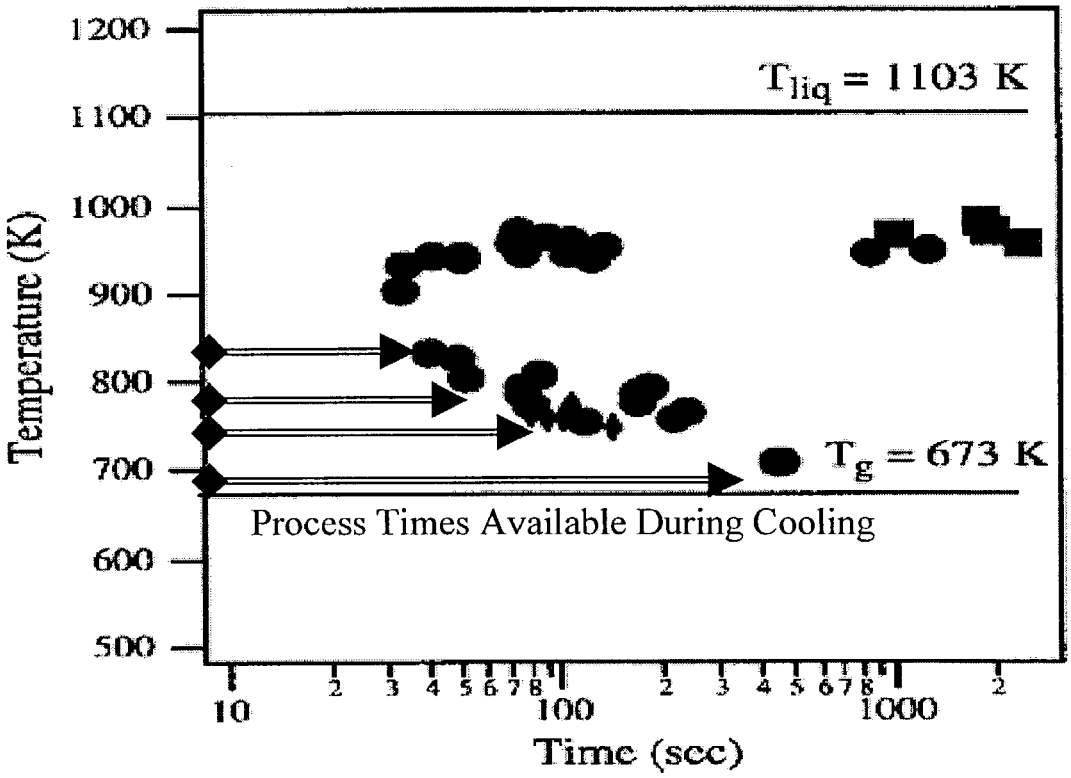
FIG. 5 is a Time-Temperature-Transformation diagram of an amorphous alloy according to the invention.

It should be understood that the TTT-diagrams in FIGS. 2 and 3 are shown schematically, and that although it appears from these diagrams that one could keep the alloy within the thermoplastic region indefinitely without crystallization occurring, it should be understood that the crystallization process has only been slowed in this region because of the increased viscosity of the alloy material, and that if held long enough at this "thermoplastic temperature" the alloy would eventually crystallize. (See for example the experimentally measured TTT-diagram in FIG. 5 showing the crystallization region and times before crystallization for an experimental Zr-based alloy.) However, although crystallization will eventually occur, even for alloys held in this thermoplastic region, the time allowed for processing is greatly expanded, allowing for the controlled casting of many different products with complex shapes and geometric features, and with very large aspect ratios.

Figure 6:
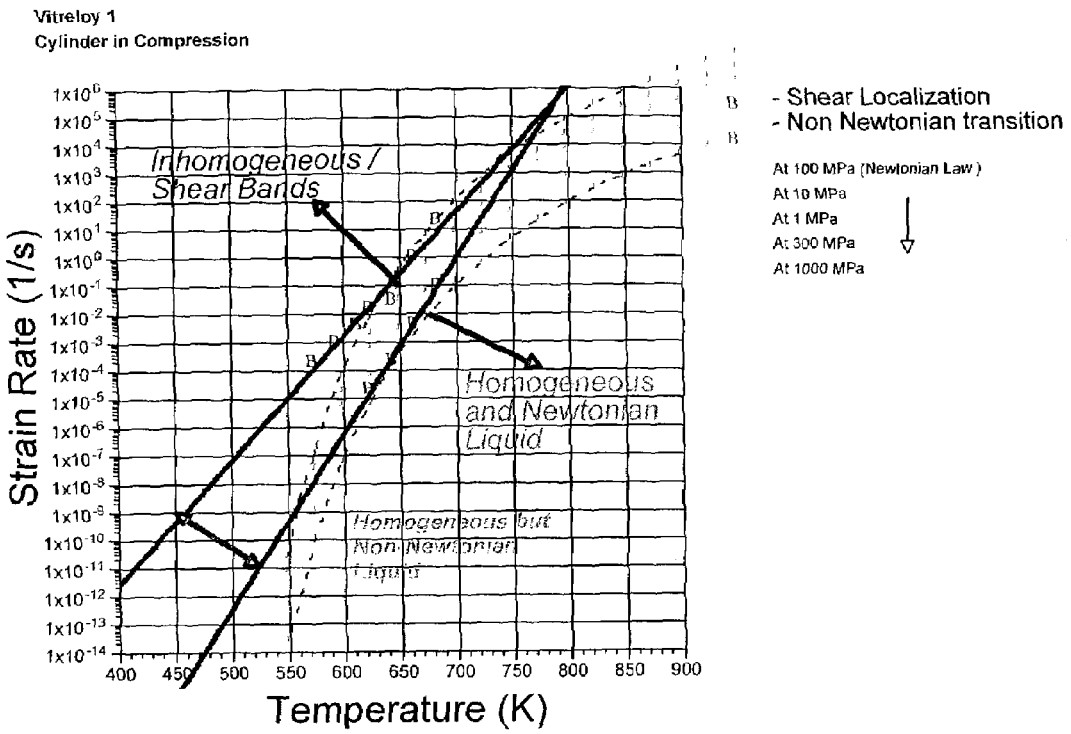
FIG. 6 is a graphical representation of the dependence of the properties of amorphous alloys on strain rate vs. temperature.

This ability to process for longer times is important because, as shown in FIG. 6, if the alloy is injected into the mold at too high a velocity or strain rate, here taken as an average liquid strain rate in $s^{-1}$ in the channel, the alloy will behave as an inhomogeneous non-Newtonian liquid, and will thus be subject to inhomogeneities, such as shear banding or atomization. In this case, strain rate can be defined as the typical velocity of the liquid along the centerline of a flow channel divided by the width or diameter of the flow channel. Accordingly, in order to ensure high-quality parts, the alloy must be injected into the mold at rates below those that result in non-Newtonian flow and instability, i.e., in a Laminar flow regime, where a Laminar flow regime (or Newtonian flow regime) is characterized by uniform and stable streamlines for the flow.

The transition to non-Newtonian flow and instability depends on the viscosity and the temperature of the alloy as well. Table I, below, shows the minimum temperatures required for specific strain rates to avoid non-Newtonian flow and instabilities in the flow patterns. Table I also gives the pressure required to achieve the given strain rates at the minimum temperature.

TABLE I

Process Conditions (Strain Rate vs. Temperature), for Vitreloy 1

| Strain Rate Control ($s^{-1}$) | Temperature (C.) | Stress Levels (MPa) |
|---|---|---|
| 0.1 | Down to 400 ° C. | Up to 10–30 MPa |
| 1.0 | Down to 430 ° C. | Up to 15–20 MPa |
| 10 | Down to 450 ° C. | Up to 20–30 MPa |

Likewise, the strain rate, the temperature used, and the TTT-diagram of the material will determine the time available for processing and the maximum aspect ratio (L/D) of the part achievable, as summarized below in Table II. The values in Table II were calculated using parameters measured for Vitreloy 1.

TABLE II

Formability of Components, Vitreloy-1

| Strain Rate of liquid in molding step B ($s^{-1}$) | TPC Temp. in Step B | Process Time Available (s) | Total Molding Strain Achievable (L/D) |
|---|---|---|---|
| 0.1 | 400° C. | 500 | 150 |
| 1.0 | 430° C. | 900 | 900 |
| 10 | 450° C. | 600 | 6000 |

Accordingly, to utilize the thermoplastic processing window, it is important to control the temperature history of the alloy during processing at a constant strain rate. Further, to ensure the best possible casting, the thermoplastic forming should be completed before the temperature falls below the minimum critical temperature for instability (Table I). Equivalently, forming should be completed before the pressure necessary to maintain the injection velocity rises above the critical value. The factors that need to be balanced for each step of the process are summarized below in Table III.

TABLE III

TPC Process Steps

| Step | Temperature | Pressure Control | Strain Rate | Process Time |
|---|---|---|---|---|
| Step A: Quenching | Start: above Tm End: TPC zone $T_{nose} > T > Tg$. | Pressure used to move melt through gates and tooling into mould is ≦ 10 MPa. | Strain rate not to exceed critical value determined by FIG. 6. Preferred ~10 to 100. | Avoid crystallization during Quenching Step. Cooling rate determined by TTT-diagram (i.e. crystallization time, t, at $T_{nose}$). |
| Step B: TPC Moulding | Start and maintain: $T_{nose} > T > Tg$ | Pressure must remain below critical value to avoid melt instabilities and wear on die tooling preferred ~10 MPa or less but must be adequate to mould part. | Strain rate used for thermoplastic moulding of component should not exceed critical strain rated at given moulding temperature, See FIG. 6. Typical rates of 0.1 to 10 per s. | Process time available determined by TTT-diagram. Must avoid onset of crystallization or onset of phase separation. Required time determined by total strain required to mold part. |
| Step C: Final Chill | Start: $T_{nose} > T > Tg$ Ends at or near ambient. Temperature or T << Tg | Pressure drops to ambient. | No strain rate moulding has been completed. | Minimize time to minimize overall cycle time. |

The method according to the invention then comprises several key features, including: (1) control of the liquid alloy flow; (2) control of the temperature history of the alloy during casting/forming; and (3) control of the turbulence of the alloy during flow and processing.

In one embodiment of the invention, for the control of the liquid alloy flow, the he strain rate are controlled during the injection of the alloy into the die. This liquid flow should be correlated with the liquid temperature history to ensure proper forming "time". In this step, the injection rate as well as the injection pressure should be monitored. By carefully monitoring these parameters, proper laminar or Newtonian flow of the liquid can be maintained and turbulence can be avoided, thereby preventing instabilities to the melt front, gas entrainment in the alloy due to cavitation, and the subsequent elimination of porosity, and inhomogeneities such as shear banding or atomization.

In a preferred embodiment of the invention, the temperature history of the liquid should also be controlled both during injection and forming of the component. This control allows sufficient time for forming and shaping the component at low pressures and low injection rates while maintaining a stable laminar flow regime. By carefully monitoring these temperature parameters, the invention allows for large overall plastic strains prior to freezing, allows replication of fine detail by increasing the available time prior to part freezing, and permits long and narrow section fabrication.

Although the above are the basic components of the thermoplastic casting method according to the current invention, additional parameters will be discussed with respect to alternative embodiments of the thermoplastic casting method and apparatus according to the invention.

Figure 7:
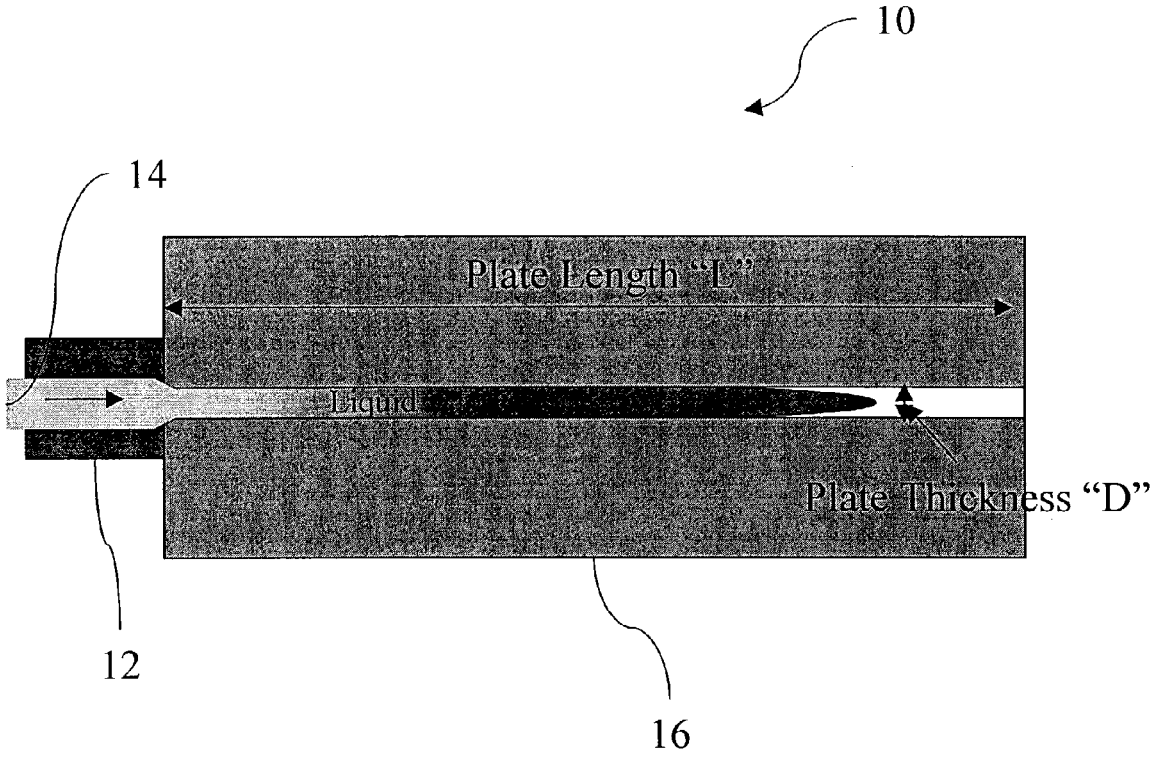
FIG. 7 is a cross-sectional schematic diagram of a thermoplastic casting apparatus according to one embodiment of the current invention.
Figure 8:
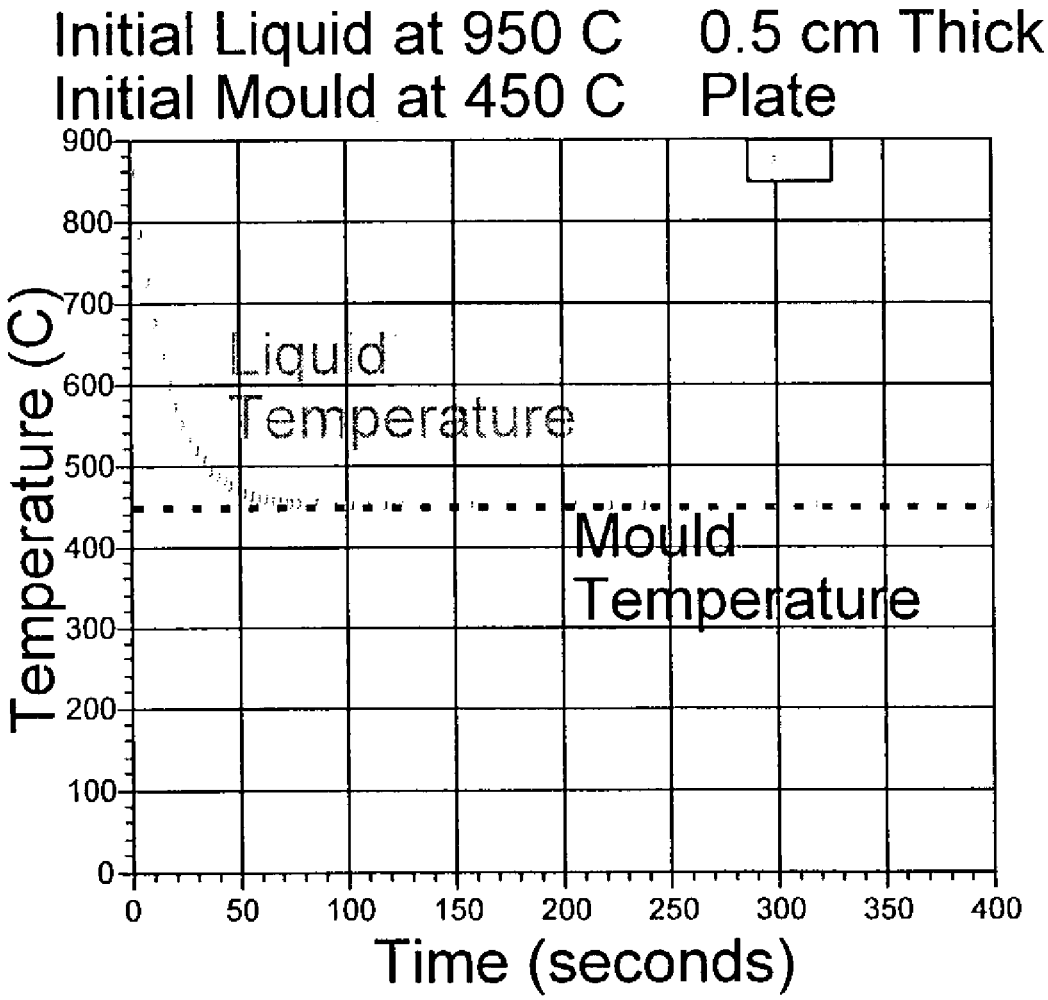
FIG. 8 is a graphical representation of the temperature vs. time history of the liquid alloy flowing through a die tool at the centerline of the liquid.

One simplified embodiment of the thermoplastic casting apparatus according to the invention is shown in schematic cross-section in FIG. 7. The apparatus 10 generally comprises a gate 12 in liquid communication between a reservoir 14 of molten liquid amorphous alloy and a heated mould 16. In such an embodiment, the liquid flows through the gate at a temperature $T_{L,O}$ near the melting temperature of the alloy. When the molten alloy contacts the mould it begins to cool as shown for Step A in FIGS. 2 and 3. The molten alloy is rapidly cooled past the critical crystallization temperature $T_{nose}$, but is stabilized above the glass transition temperature, $T_g$, by the heated mould, which is held at a temperature $T_{M,O}$. By heating the mould, the relaxation of the liquid alloy temperature to the mould temperature is extended. As shown in FIG. 8, the liquid alloy temperature will relax exponentially to the mould temperature with a time constant $\tau_V$.

Figure 9:
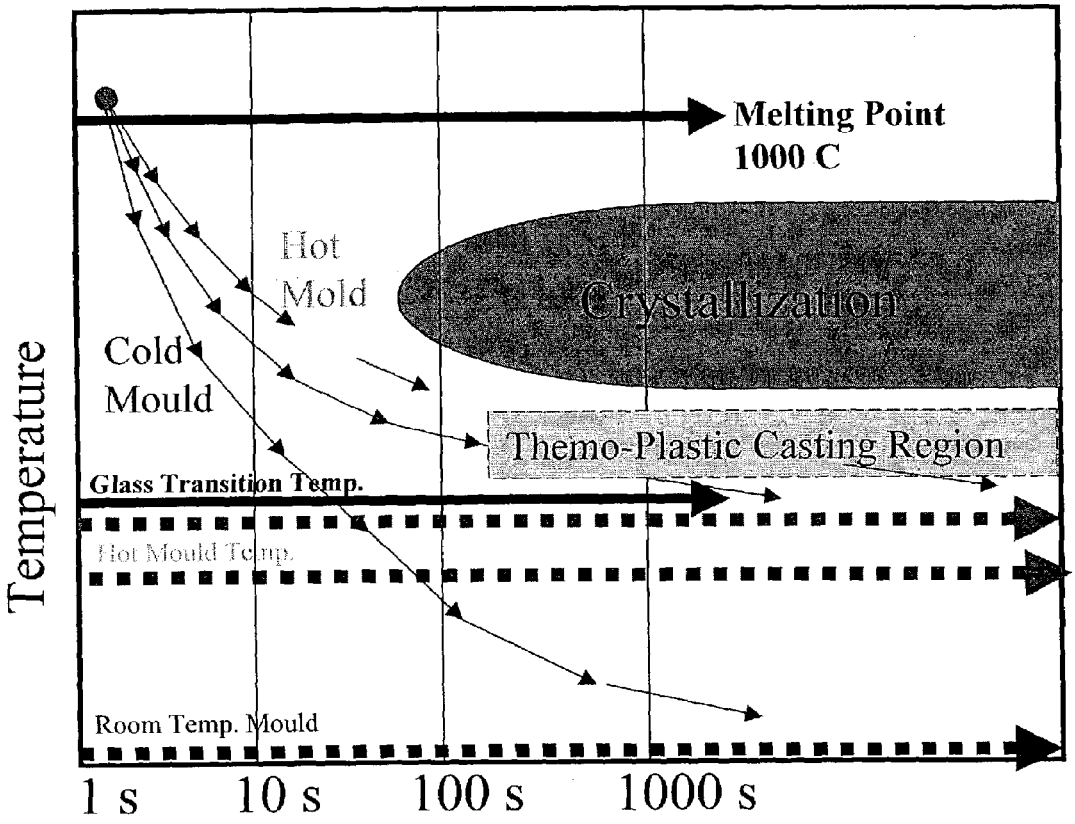
FIG. 9 is a graphical comparison of a thermoplastic casting process according to the current invention vs. a conventional casting process.

For example, FIG. 9 shows plots of a conventional amorphous alloy cold casting method in comparison with a heated mould thermoplastic casting process according to the current invention. In the conventional cold mould method, the alloy is rapidly cooled below the glass transition temperature. While such a process ensures that the alloy will not undergo crystallization, the processing time available is greatly reduced, limiting the types of parts that can be made and also requiring the use of high-speed injection molds to ensure sufficient alloy material is placed into the mould prior to solidification.

Although so far only experimentally determined temperature histories have been discussed, it should be understood that the temperature history of a liquid alloy can be determined prior to processing by solving the Fourier heat flow equation for the liquid alloy at some initial temperature injected into a mould at some other initial temperature, such as in the apparatus depicted in FIG. 7. (See, W. S. Janna, *Engineering Heat Transfer*, p. 258, the disclosure of which is incorporated herein by reference.) By solving the fundamental process inequalities and observing the fundamental time scales, practical and measurable process parameters such as size and complexity of a castable piece may be determined.

For example, the process conditions for the material Vitreloy-1 can be first estimated theoretically and a temperature history produced. The result of one such calculation is shown schematically in FIG. 3. In this example, the thermal conductivity of liquid Vitreloy-1 ($K_v$) is 18 Watts/m-K; the thermal conductivity of a exemplary copper mould ($K_M$) is 400 Watts/m-K; the specific heat ($C_p$) of Vitreloy-1 (@ 500° C.) is 48 J/mole-K or 4.8 J/cc-K; and the molar density of Vitreloy (ρ) is 0.10 cc/mole. Given such values, the thermal diffusivity of Vitreloy-1 can be expressed as $K_v/C_p$=0.038 $cm^2/s$. We can assume that the thermal diffusivity of the mould is much greater than the liquid Vitreloy. Accordingly, the thermal relaxation time of the liquid alloy in the mould can be roughly given by the equation:

$$\tau_v=D^2/4K_v, \quad (1)$$

where D is the thickness of the moulded part.

Assuming no thermal impedance at the mould/liquid alloy interface, i.e., no shrinkage gap, for a part thickness of 1.0 cm, the thermal relaxation time of the liquid alloy is about $\tau_v$=6 s. Using this number it is clear that at a temperature of 450° C. there is an available process time (according to Table II) of about 500 seconds. Accordingly, using a heated copper mould, there is ample time to process the alloy under near isothermal conditions at strain rates as high as 10 $s^{-1}$, under homogeneous Newtonian flow conditions, and near isothermal conditions in the liquid. Given these conditions, a total strain of about 5000 could be achieved to produce a plate a total of about 25 meters long. As a result, batch or even continuous sheets of metallic glass can be produced.

It should be understood that the above process is best performed under near isothermal conditions with the molten liquid in Step B, and the analysis used here applies only to cases approaching isothermal conditions. Under these conditions, the sample behaves as a uniform fluid. If temperature gradients are present in the liquid, which flows in the mold during Step B, the flow will be inhomogeneous and the analysis is more complicated.

Figure 10:
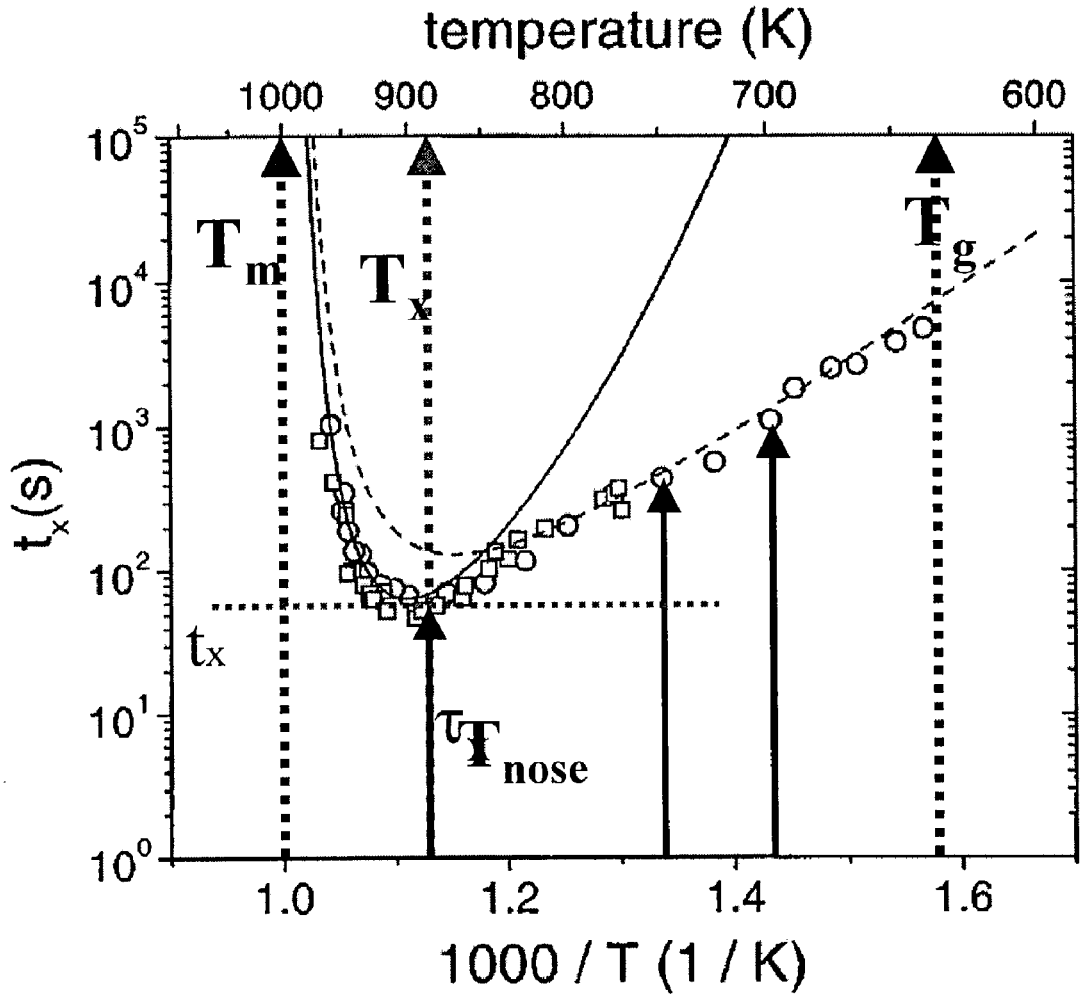
FIG. 10 is a Time-Temperature-Transformation diagram of an amorphous alloy according to the invention.

By comparison to the calculated values above, FIG. 10 shows a measured TTT-diagram for Vitreloy 1. In this diagram, $T_m$ is the alloy melting temperature (liquidus), $T_x$ is the crystallization temperature (at the "nose"), $T_g$ is the glass transition temperature (defined as the temperature where the viscosity of the alloy is $10^{12}$ Pas-s), and $T_{nose}$ is the point at which the time to onset of crystallization is at a minimum, here about 60 seconds.

The relationship between $T_{nose}$ and the critical casting thickness and the critical cooling rate for a glass forming alloy can be determined, as above, from the solution of the heat flow equations for a cylinder and a plate. (See, W. S. Janna, *Engineering Heat Transfer*, p. 258, the disclosure of which is incorporated herein by reference.) In these calculations, we assume the mould has a temperature at $T_g$, and the initial molten alloy has a temperature, $T_i$, equal to ($T_m$+100° C.). Assuming again that the mould has a high thermal conductivity (e.g., molybdenum or copper), one can obtain the following relationships for a plate of total thickness L:

$$t_x=t(T_{nose})=2.4\ (s/cm^2)\times L_{crit}^2=60\ s \text{ (for Vitreloy-1)}$$

$$R_{crit}=42(Kcm^2/s)/L_{crit}^2=1.7\ K/s \text{ (for Viteloy-1)},$$

and for a cylinder of diameter D:

$$t_x(T)=T_{nose}=1.2\ (s/cm^2)\times D_{crit}^2=60\ s \text{ (for Vitreloy-1)}$$

$$R_{crit}=84(Kcm^2/s)/D_{crit}^2=1.7\ K/s \text{ (for Vitreloy-1)},$$

where $L_{crit}$ and $D_{crit}$ are the critical casting dimension parameters in centimeters below which one obtains an amorphous alloy, $R_{crit}$ is the critical cooling rate to obtain glass in Kelvin per seconds, and $t_x$ is the critical minimum time to crystallization at the temperature $T_{nose}$. Utilizing these relationships, it is possible to convert a critical casting thickness into a minimum crystallization time, $t_x$, or to a minimum critical cooling rate for producing an amorphous object.

In relation to FIG. 8, above, we can define a thermalization time, $\tau_T$, as the time required for the temperature of an alloy melt to relax from the initial melt temperature, close to (~90%) of the way, to a final mould temperature ($T_M$). This is also the time scale to achieve a uniform temperature in the liquid layer. More specifically, after $2\times\tau_T$, there is only 1% temperature variation in the molten alloy liquid. Accordingly, the centerline temperature will follow a time dependence according to Equation 2, below.

$$T(t)=T_M+\Delta T\ e^{-t/\tau} \quad (2)$$

where the thermalization time $\tau_T$=ln(10)τ, and the thermal diffusivity of the liquid is (κ in ($cm^2/s$)=0.038 $cm^2/s$) (for Vitreloy-1). This can of course be adjusted for other materials. Again from the solution of the heat flow equation the following thermalization times are obtained for a Vitreloy-1 plate of thickness, L:

$$\tau_{T=0.25}\ L^2/\kappa=6.6(s/cm^2)\times L^2,$$

and for a Vitreloy 1 cylinder of diameter, D:

$$\tau_{T=0.12}\ D^2/\kappa=3.1(s/cm^2)\times D^2.$$

For example, a 1 cm thick plate of Vitreloy 1 has a $\tau_T$ of 6.6 seconds. (It should be noted that the thermalization temperature is relatively independent of the initial and mould temperatures.)

A minimum mould time $\tau_M$ for molding a particular component can also be determined from these equations. The minimum time required to mold an object or shape can be defined in several ways. The total strain $\epsilon_{tot}$ that the liquid must undergo to form the part could be determined. This is equal to the greatest aspect ratio of the part. For example, a plate of length s and thickness L will require a total strain of $\epsilon_{tot}$~s/L. Accordingly, if the strain rate during molding is $\epsilon_t$, then the molding time may be found according to Equation 3, below.

$$(\epsilon_{tot}/\epsilon_t)=\tau_M. \quad (3)$$

Alternatively, the molding time might be determined in terms of the time required to fill a mould with liquid injected at some volumetric rate (volume/s). For instance, if liquid is injected through a gate into a mold cavity, we must fill the mold cavity to produce the component. If V is the volume of the mold cavity and dv/dt is the injection rate, then the molding time can be expressed according to Equation 4, below.

$$\tau_M=V/[dv/dt] \quad (4)$$

Using the above Equations, it is possible to write down the fundamental inequalities for the thermoplastic casting process. In Step A, the initial quench step, the temperature is lowered from $T_{melt+\Delta Toverheat}$, to $T_{mould}=T_g+\Delta T_{mold}$. This occurs in a processing time, $\tau_A$. This time is equal to the time that it takes for liquid alloy to move through the "A" stage of the TPC process. In most cases the following inequalities are required for the Step A process:

$$\tau_T<\tau_A<t_X \quad (I)$$

As will be discussed later, the use of a heat exchanger will reduce $\tau_T$, allowing for a shorter $\tau_A$. In fact, $\tau_T$ is directly related to the individual "channel thickness" D shown in FIG. 7, in Step A (multiple channels can be used in parallel). Although inequality (I) is required for most embodiments, it should be understood that a heat exchanger with small channel dimensions may well enable Step A to be successfully carried out when it would not otherwise be possible to satisfy the inequality in (I).

In Step B, the molding/shaping step, the sample is formed into a net shape. This may be a rod, plate, tube, or another more complex shape (e.g. cell phone or watch case). This step is accomplished in a time scale $\tau_B$ at a target temperature $T_B$. This time scale should satisfy the following inequality:

$$\tau_M(T_B, \epsilon_t)<\tau_B<\tau_x(T_B) \quad \text{(II)}$$

Here the time scales $\tau_M$ and $\tau_x$ depend explicitly on the temperature $T_B$, and on the strain rate ($d\epsilon/dt=\epsilon_t$) at which the process is carried out. All other variables (e.g. the pressure gradient required to maintain the strain rate) are determined by $T_B$ and $\epsilon_t$. Thus, these parameters can be taken as the two independent process variables. Equivalently, we could use pressure P and temperature $T_B$ as controlled variables (with $\epsilon_t$ determined from these).

Figure 11:
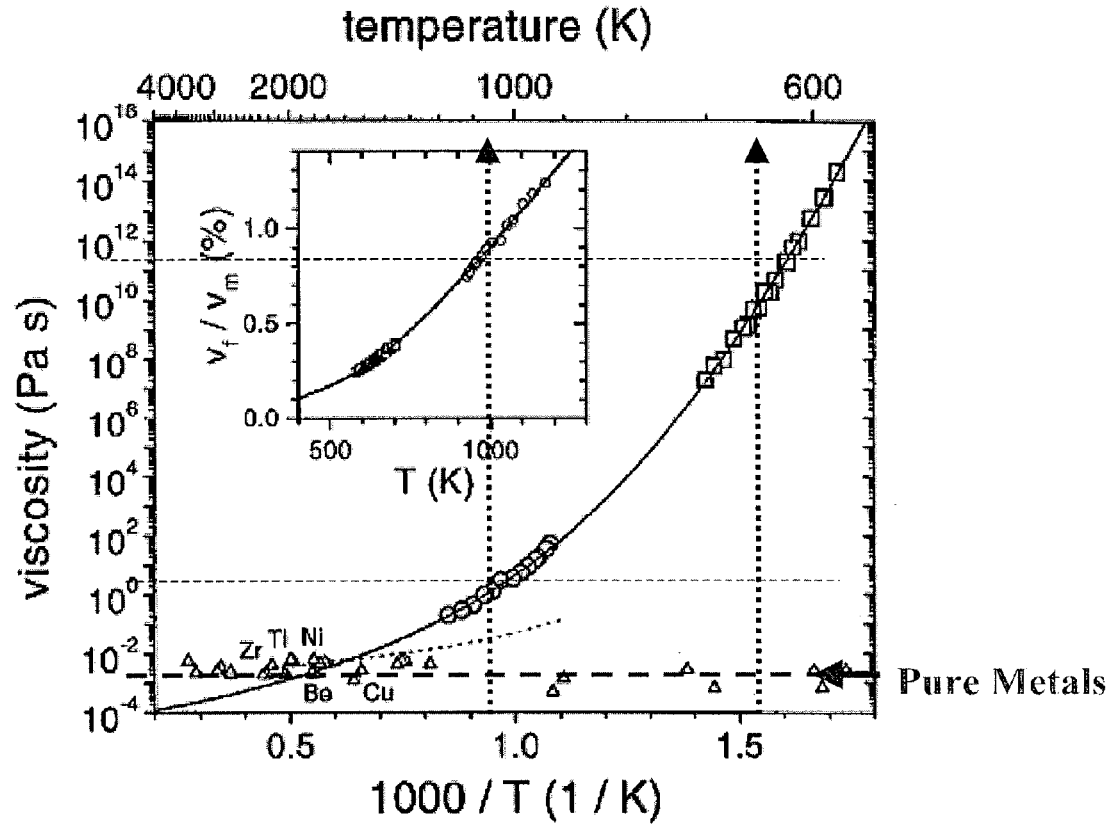
FIG. 11 is a graphical representation of the dependence of the properties of amorphous alloys on viscosity vs. temperature.

As an example, in the case of Vitreloy 1, if $\epsilon_t=1\ s^{-1}$, and the temperature $T_B$ is chosen to be ~80 C. above $T_g$, or T or $T_B$=700 K (427 C.), we find $\eta(T)=2\times10^7$ Pas-s, as shown in FIG. 11. From this value of viscosity, we can determine the pressure gradient required to maintain the strain rate using standard solutions to the Stokes equation, and TM can then be related to the basic processing parameters. For example, to fill a mold of length S and thickness L requires a total strain $\epsilon_{tot}$=S/L, and a total time $\tau_M$=L/(S $\epsilon_t$). The pressure required to achieve the assumed strain rate depends on the alloy viscosity at temperature $T_B$, which can also be computed, as shown in FIG. 11.

Although the apparatus shown in FIG. 7, and discussed above is a simplified version of the invention, it should be understood that several features can improve the operation of such an apparatus including: (1) inverted (counter-gravity) liquid injection; (2) controlled gas atmosphere or vacuum environment within melting injection and mould systems; and (3) continuous melt supply, i.e., repetitively filled moulds.

Each such alternative embodiment has at least one advantage. The inverted liquid injection prevents gas entrainment and pore formation, the controlled gas atmosphere prevents oxidation of the liquid alloy during the process, and the continuous melt enables rapid throughput and controlled viscosity and injection characteristics of the liquid.

In FIG. 3 a TTT comparison of a Vitreloy-1 material versus a marginal amorphous alloy is shown. Because of the marginal glass properties of the non-Vitreloy alloy, the length of time available to process the marginal amorphous alloy is greatly reduced. Accordingly, it is necessary to reduce the temperature of the alloy more rapidly to bypass crystallization at the $T_{nose}$. As a result, it would seem to be impossible to create pieces having the same dimensional sizes as those made with the more processable Vitreloy-1 alloy material.

FIG. 12 shows a modification of the basic TPC apparatus that makes such larger dimensioned plates and pieces, possible. Specifically, FIG. 12 shows an alternative embodiment of the invention directed to an apparatus for increasing the critical casting thickness of glass forming alloy plates using an expander region in the mould. As in the conventional TPC apparatus, the expander TPC apparatus 20 shown in FIG. 12 also contains a gate 22 in fluid communication between a reservoir 24 of molten liquid alloy material and a heated mould 26. However, the heated mould has a region of expanded dimension 28, which enlarges the dimensional size of the cast plate (Step B) once the alloy has been rapidly cooled past the critical "nucleation or crystallization nose" (Step A). This expander zone 28 allows for the casting of amorphous alloy plate sections of much greater dimensional thickness than would be possible in a single size mould. The cast piece 30 then enters a chiller 32, which rapidly freezes the final metal plate 34 article to ambient temperature (Step C).

Figure 13:
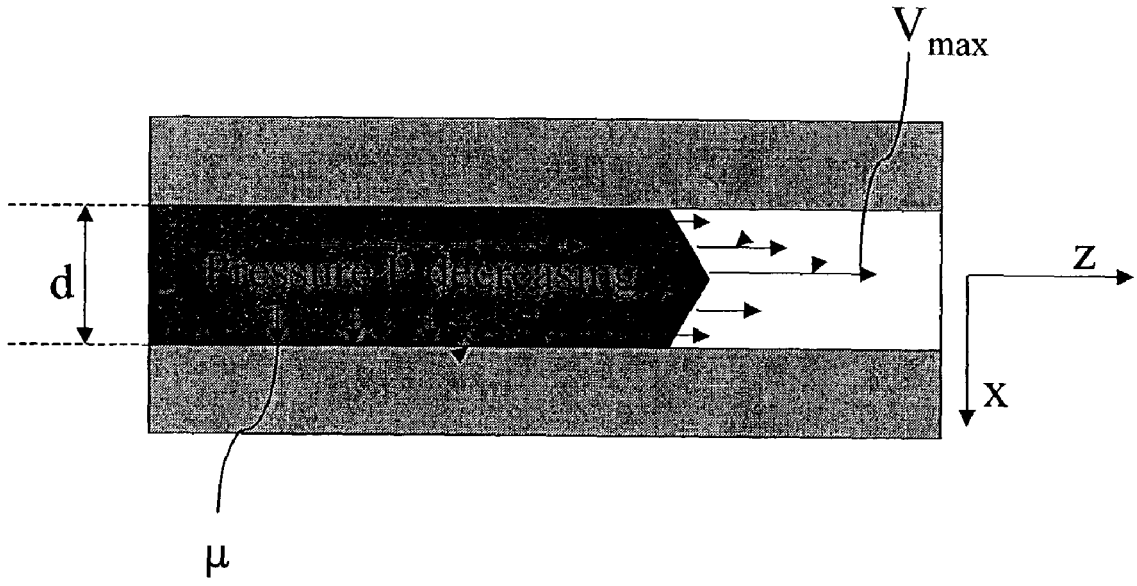
FIG. 13 is a cross-sectional schematic diagram of a portion of a thermoplastic casting apparatus according to one embodiment of the current invention. The diagram illustrates the conditions required to maintain a non-slip boundary condition at the interface between the melt and the die tool.

In the plate extrusion, expander, and related thermoplastic casting apparatusses discussed above, special attention needs to be paid to the boundary between the die tools and the undercooled liquid. Particularly, it is important to control the behavior of the flowing liquid at the interface. In short, the interface can either be non-slipping or slipping depending on the friction between the die and melt. To be non-slipping the surface of the mould must have a specified level of traction according to Equation 45, below.

$$\tau \sim \eta \frac{V_{\max}}{d} \quad (5)$$

where $\tau$ is the traction, $\eta$ is the liquid viscosity, $V_{max}$ is the melt velocity field for non-slip boundary, and d is the size of the flow path. As shown schematically in FIG. 13, the maximum velocity, $V_{max}$, of the melt is found at the center of the melt away from the walls of the mould. In turn, the liquid viscosity, $\eta$, during Step B of the process is determined by the TPC process map conditions (viscosity depends on mould temperature etc., as is shown graphically in FIG. 11). This property then determines the minimum static friction coefficient required to maintain no interfacial slip, according to Equation 6, below.

$$\mu > \eta \frac{V_{\max}}{Pd} = \eta \frac{\varepsilon Y'}{P} \quad (6)$$

where $\mu$ is the frictional coefficient, P is the pressure, and $\epsilon Y'$ is the strain rate.

The friction coefficient, $\mu$, can be controlled by surface roughness of the die tool, and/or by use of die lubricants, etc. For example, to maintain non-slip conditions, such that the liquid alloy continues to interact with the walls of the dies, the surface must be sufficiently rough. The die tool surface roughness can be controlled to achieve this, e.g., a polished die tool section can be used if a low $\mu$ and interfacial slip/sliding, etc. is desired. For example, for plate extrusion it is desirable that the interface slip before the melt leaves the tool. This slipping at the end of the casting prevents "melt bulge" in the extruded sheet—improving the quality of the sheet. Accordingly, in such an embodiment the last section of the extrusion tool could be polished to optimize high quality sheet production.

FIG. 14 shows a detailed view of the expander region of the heated mould. In the TPC expander described earlier in FIG. 12. In such an embodiment, an interfacial slip is not desired since the metal should "bulge" into the expanded region. Accordingly, the tools should be roughened in the "expansion zone". With a no slip condition, the melt will "bulge" into the "expanded zone", and a thicker sheet will be formed. In fact, the "bulging" will occur at a certain rate as the liquid passes through the "expansion zone". To prevent slip, the expansion zone must be tapered so that "bulging" keeps up with melt flow to maintain the non-slip condition. For example, preferably the expansion zone surface 40 has a specified "rms roughness" 42 with an expansion "pitch" angle 44 less than about 10 degrees to about 5 degrees, such as is described in FIG. 14. Additionally, the expander apparatus may preferably have accurate mould temperature control, such as a feedback control loop, control of the melt injection temperature, control of the liquid injection velocity, and control of the maximum pressure for a given injection velocity.

Although the discussion thus far has focussed only on the use of TPC to form pure amorphous alloy materials, the TPC method can be used to fabricated composite materials with "tailored" properties. This can be accomplished by "mixing" a solid phase with a glass forming liquid in the initial stages of TPC processing and consolidating the mixture into a "net shape" in the final stages of processing. TPC composite manufacturing could be used to make rods, plates, and other net-shaped parts. For example, such a process could be used in the continuous manufacture of composite penetrator rod stock.

Figure 15:
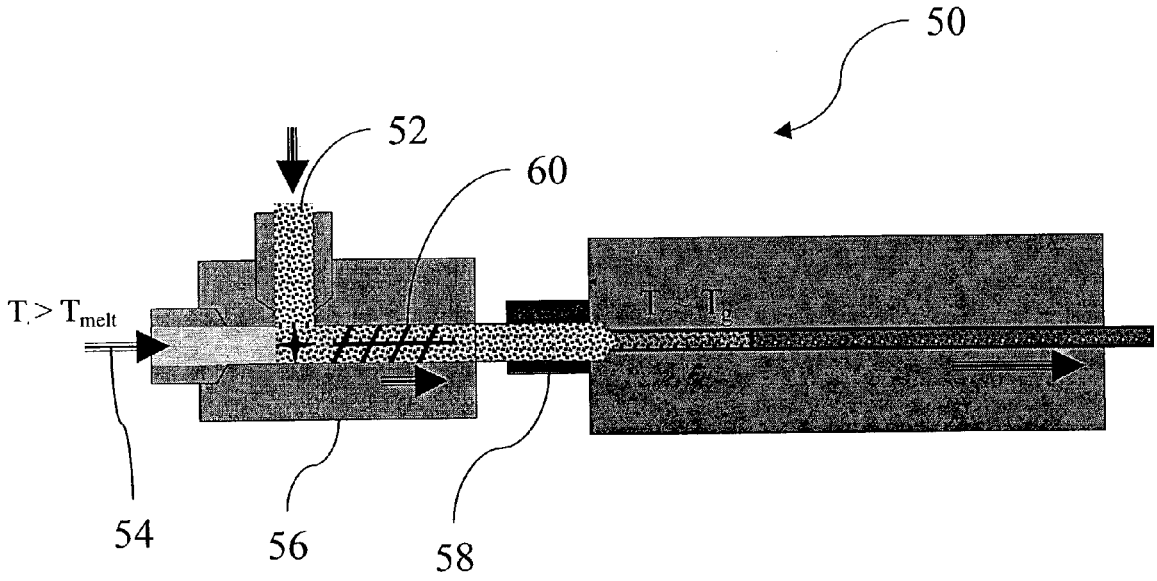
FIG. 15 is a cross-sectional schematic diagram of a thermoplastic casting apparatus according to one embodiment of the current invention. The apparatus is used to make composite materials containing a mixture of an amorphous alloy and a second material.

One example of an apparatus 50 for TPC composite manufacturing is shown in FIG. 15. In this embodiment, a solid powder 52, such as a reinforcer is mixed with the liquid alloy 54 in a mixer/agitator 56 prior to flowing into the gate 58. A screw feed mechanism 60 is utilized to ensure that the alloy is feed into the gate at the proper rate. Once in the gate the apparatus is identical to that described in FIG. 7, above. Utilizing the mixer, a composite alloy material can be produced in either batch or continuous feed processes. It is preferred in such an embodiment that there be precise control of the volume fraction of the reinforcer powder, precise control of the size distribution of the reinforcer powder, and minimal reaction between the matrix/reinforcement due to limited process times at relatively low temperatures.

Figure 16:
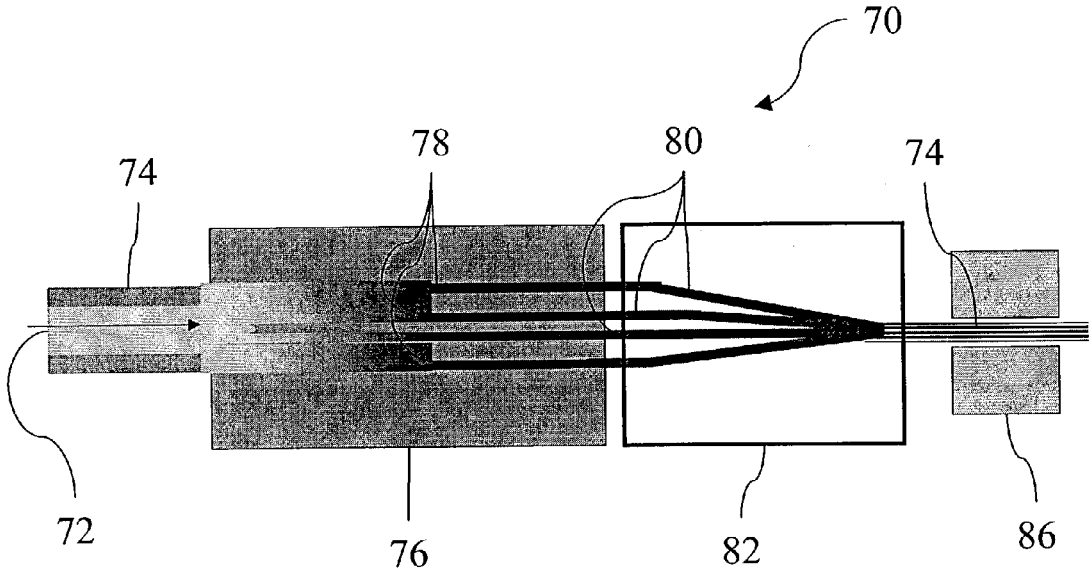
FIG. 16 is a cross-sectional schematic diagram of a thermoplastic casting apparatus according to one embodiment of the current invention. The apparatus is used to make braided wires.

In yet another alternative embodiment, a TPC wire and/or braided cable apparatus 70 is shown schematically in FIG. 16. In this embodiment, a liquid alloy 72 is fed through a gate 74 into a heated mould 76. However, the mold comprises a plurality of channels 78 designed to divide the alloy flow such that a multiplicity of hot flows of liquid alloy are fed through the hot mold to form individual braids 80 of a wire or cable. These individual strands are then braided in a braiding apparatus 82 held at the moulding temperature, and then the braided wire 84 is chilled to ambient temperature to form a multi strand wire or cable in the chiller 86. Utilizing such an apparatus, cables and wires of various dimensions and properties can be formed.

Finally, a more detailed depiction of an extrusion die tool 90 for forming continuous sheets of material is shown schematically in FIG. 17. This embodiment shows in more detail the melting stage 92, the heat exchanger 94, the injector 96, and the die tool 98. Although any suitable melting stage capable of maintaining an initial melt temperature and an initial injection pressure may be used, the simple embodiment shows a container 100 having an RF heating temperature control 102 and a column height pressure controller 104. In another embodiment, the melting stage may also comprise a pre-treatment stage for soaking the melt, and a stirring device for ensuring an isothermal melt.

Figure 18:
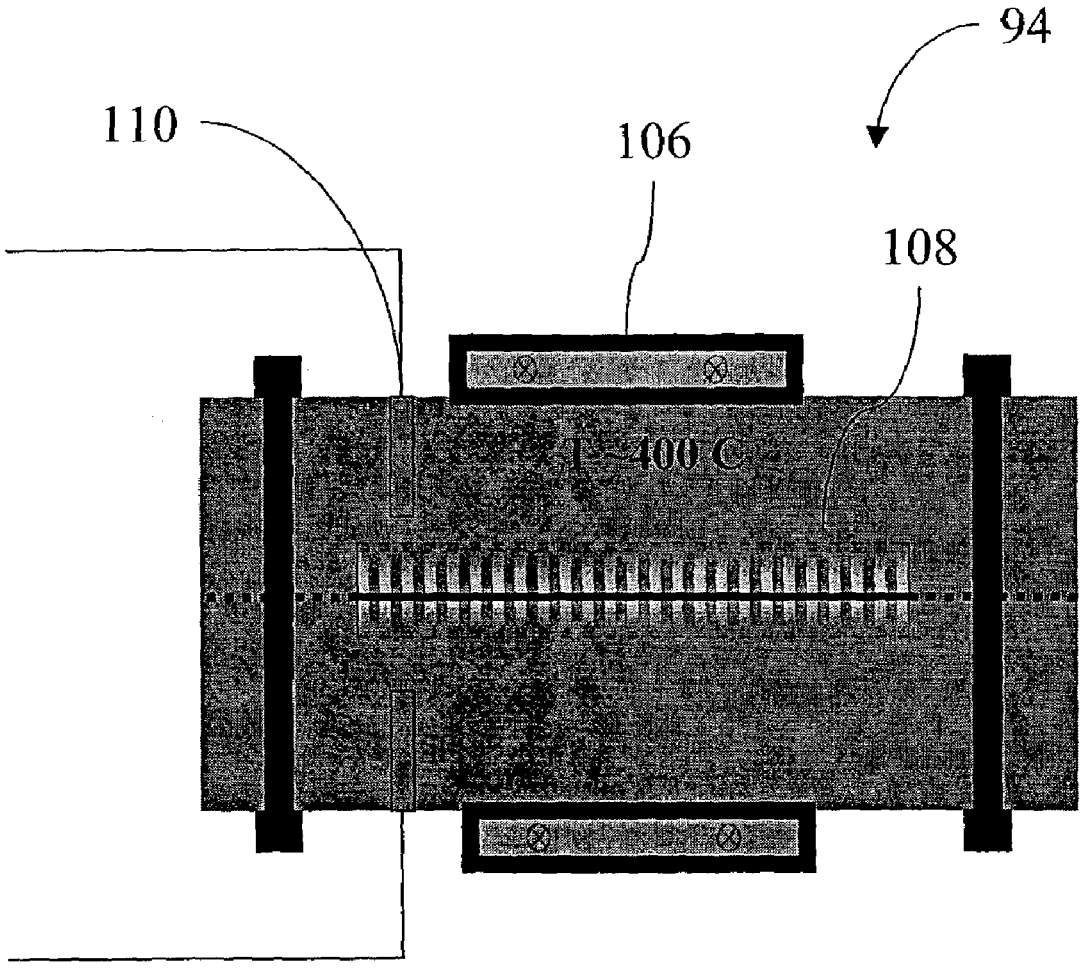
FIG. 18 is a cross-sectional schematic diagram of a heat exchanger section of the thermoplastic casting apparatus according to one embodiment of the current invention shown in FIG. 17.

Likewise, although any suitable heat exchanger can be used for the quenching stage, the quenching stage 94 shown in more detail in FIG. 18 includes a combination of conduction and convection flow patterns to achieve adequate quenching and to avoid the crystallization nose of the material. For example, the exemplary embodiment of the heat exchanger 94 shown in FIG. 18 has an active cooler 106, and utilizes narrow flow channels and shaped fins 108 to promote heat exchange by a combination of conduction and convection to rapidly cool the alloy below the nose temperature. The heat exchanger is also provided with a thermocouple 110 to sense the temperature and a cold gas flow for the active control of the temperature.

Finally, any injector suitable for controllably feeding the liquid alloy into the die tool may be utilized. In the exemplary embodiment shown in FIG. 17, the injector 96 is a control screw drive 112 where rotation frequency, control pitch, and screw compression can be utilized to achieve the desired pressure and flow velocity in the injector. A flow meter can be connected to a computer feedback control 114 to control these parameters. Such a computer control can also control the pressure and temperature of the melt stage, the temperature of the heat exchanger, and the injector speed, thereby actively maintaining the process within the thermoplastic process window required during Steps A and B.

The use of a heat exchanger to actively control the quench temperature of the liquid alloy can also be utilized to expand the critical casting thicknesses of the material. For example, an analysis was conducted on the cooling profiles for a 5 mm thick liquid layer of the Vitreloy-106 material, the TTT diagram of which is shown in FIG. 5, based on the solution of the material's heat flow equation. This analysis determined that for a 5.0 mm thick slab of Vitreloy-106, heat conduction only gives 6.9 s for the centerline temperature, $T_o$, to drop to 0.1 of the initial temperature, where $\Delta T = T_{initial} - T_{mould}$. If the initial temperature, $T_{initial}$=1200K, and the temperature of the mould, $T_{mold}$=673 K, then at 6.9 s the centerline temperature is 726 K, and at 13.8 s the centerline temperature is 678 K. The cooling rate average during the initial 6.9 s is (527K/6.9s)=76 K/s. However, while "passing the nose" at 900 K, the alloy has a critical cooling rate of (300 K/2.4 s)=125 K/s. Accordingly, ambient cooling will not allow for the production of an amorphous material in this example.

Similarly, the following formulas can be derived from solutions to the heat flow equation for a cylinder and a plate of liquid alloy cooled by simple heat conduction in a thick mould. The formulas assume that the thermal conductivity of the mould is at least ~10 times that of the liquid alloy. In the equations, $T_l$ is the liquidus temperature of the alloy, $\kappa$ is the thermal diffusivity of the alloy $\kappa = K_t/C_p$, $K_t$ is the thermal conductivity of the mould in Watts/cm-K (exemplary values for K for typical mould materials such as copper and molybdenum are $K_{cu}$=400 Watts/m-K and are $K_{Mo}$=180 Watts/m-K), and $C_p$ is the specific heat of the alloy (per unit volume in J/cc-K). The cooling rate is related to the sample dimensions (plate thickness L, cylinder diameter D—in cm), by using the cooling rate at the mid-line of the sample (plate center or cylinder center) when the temperature of the centerline passes from $0.85T_l$ to $0.75\ T_l$. This is the location of the "nucleation nose" for a sample with a reduced glass transition temperature, $T_g/T_l$=0.6 (typical of good glass formers). The result is relatively independent of the mould temperature. It is also relatively independent of the details of the glass forming alloy (e.g. $T_g/T_l$). With these assumptions, the critical cooling rate can be related to the critical casting thickness as follows:

$R_{crit}^{plate}$=critical cooling rate ($K/s$)=0.4 $\kappa T_l/L_{crit}^2$=0.4 $K_t Tl/(C_p L_{crit}^2)$ for a plate of thickness $L$.

$R_{crit}^{cyl}$=critical cooling rate ($K/s$)=0.8 $\kappa T_l/D_{crit}^2$=0.8 $K_t T_l/(C_p D_{crit}^2)$ for a cylinder of diameter $D$.

For example, for Vitreloy 1, K=0.18 Watts/cm-K, $C_p$=5 J/cm$^3$-K, $T_l$=1000 K, we then have:

$R_{crit}^{plate} \approx 15/L^2$ ($L$ in cm)→with a critical cooling rate of 1.8 $K/s$ $D_{crit}$=2.9 cm.

$R_{crit}^{cyl} \approx 30/D^2$ ($D$ in $cm$)→with a critical cooling rate of 1.8 $K/s$, $D_{crit}$=4.1 $cm$.

Critical cooling rates of various alloys estimated from sample relations using thermo-physical properties of Vitreloy-1 (a good approximation in general), are shown below in Table IV.

TABLE IV

Critical Cooling Rates

| Alloy | Experimental Casting Thickness (cm) Cylinder | Plate | Critical Cooling Rates |
|---|---|---|---|
| Vitreloy 1 | 4.1 cm$^c$ | 2.9 cm | 1.8 K/s$^m$ |
| Vitreloy 101 | 0.35 cm$^m$ | 0.25 cm | 247 K/s$^c$ |
| Vitreloy 4 | 1.2 cm$^m$ | 0.9 cm | 21 K/s$^c$ |
| | | | 26 K/s$^m$ |
| Vitreloy 106a | 1.9 cm$^c$ | 1.35 cm | 7 K/s$^m$ |
| Fe-based glass | 0.35 cm$^m$ | 0.25 cm | 247 K/s$^c$ |
| Ni-based Glasses | 0.3 cm$^m$ | 0.21 cm | 340 K/s |

(c = calculated)
(m = measured)

The use of heat exchangers to expand the critical casting thicknesses can also be modeled using a theoretical TTT-curve, a rheology based on Vitreloy-1, and assuming a heat exchanger structure with 1 mm channels as shown in FIG. 18. The TTT-curves of various alloys can be estimated by shifting the time of the $t_x(T)$ curve of the Vitreloy-1 TTT-diagram. In other words, a TTT-diagram of Vitreloy-1 or Vitreloy-106 (measured) can be taken, and a time scaling methodology used with the entire curve shifted in time by $\lambda t$, where $\lambda$ is the ratio of the time to the nose of the alloy to the time to the nose of Vitreloy-1.

Using these relations, to cast a 1 cm thick expanded plate, a 1 mm channel (channel width of 1 mm and "fin" width also 1 mm) expander is used and the material is then moved into an open 1 cm plate. The exchanger will reduce flow by a factor of $r_1$~100, unless compensated by an increase in casting pressure gradient. Accordingly, total casting pressure will be higher (~100 MPa). This can be done without penalty since flow instability in the exchanger will not reduce part quality (instabilities are damped in the final molding stage (e.g. open plate). Accordingly, a total strain of at least $\epsilon_{tot}$~10 is needed to cast the 1 cm thick plate (in the open section). A factor of $\lambda$ is lost in process time (at the TPC temperature). Thus, it is necessary to compare the total TPC strain available in Vitreloy-1 (TPC processing charts). For Vitreloy-101, for example, a total strain of 10 must be attained in a time shortened by $\lambda$. The required condition for a viable process (using available strain of 6000 in 600 s (Vitreloy 1) becomes:

$$\epsilon^{available}=6000/\lambda=6000/137=44>\epsilon_{tot}=10. \quad (7)$$

Which is Achievable as Shown in Tables I and II.

In conclusion, with 1 mm channels, cooling rates will be ~1000 K/s. Accordingly, a 1 cm thick plate of a Ni-base or Fe-base alloy can be cast using a continuous casting method according to the present invention. Further, all the alloys listed in Table IV become highly processable using the heat exchanger methods of the present invention. Therefore, using an active heat exchanger apparatus according to the embodiment of the present invention shown in FIGS. 17 and 18, the critical cooling rate is no longer a limitation for making components with ~1 cm thicknesses. The method essentially provides a means of "leveraging" the processability of metallic glass forming liquids allowing enhancement of critical casting dimensions and opening a much wider range of alloy compositions from which components can be fabricated.

It should be understood that although the above-discussion of TPC apparatus have focussed on generic moulds and die tools, that any suitable shaping tool may be utilized with the current invention. For example, closed-die or closed-cavity dies, such as split-mold type dies may be used to make individual components. Alternatively, open-cavity dies, such as extrusion die tools may be used for continuous casting operations.

The invention is also directed to products made from the thermoplastic casting process and apparatus described herein. For example, because of the high-quality defect free nature of the TPC process, the method may be used to produce components with submicron features, such as optically active surfaces. Accordingly, micro or even nanoreplication is possible for ultra-high precision components, i.e., products with functional surface features of less than 10 microns. In addition, the extended process times above $T_g$ along with the near isothermal conditions of TPC allow substantial reduction of internal stress distributions in parts, allowing for the production of articles free of porosity, with high integrity, and having reduced thermal stress (less than about 50 Mpa). Such components may include, for example, electronic packaging, optical components, high precision parts, medical instruments, sporting equipment, etc. Preferably, the alloy comprising the end-product has an elastic limit of at least about 1.5%, and more preferably about 1.8%, and still more preferably an elastic limit of about 1.8% and a bend ductility of at least about 1.0%, indicating superior amorphous properties.

The preceding description has been presented with reference to presently preferred embodiments of the invention. Workers skilled in the art and technology to which this invention pertains will appreciate that alterations and changes in the described structures and processes may be practiced without meaningfully departing from the principal, spirit and scope of this invention.

Accordingly, the foregoing description should not be read as pertaining only to the precise structures described and illustrated in the accompanying drawings, but rather should be read consistent with and as support to the following claims which are to have their fullest and fair scope.

What is claimed is:

1. A method of thermoplastically casting an amorphous alloy comprising the steps of:

providing a quantity of an amorphous alloy in a molten state above the melting temperature of the amorphous alloy (Tm);

cooling said molten amorphous alloy directly to an intermediate thermoplastic forming temperature range above the glass transition temperature of the amorphous alloy and below the crystallization nose temperature, where the crystallization nose temperature ($T_{NOSE}$) is defined as the temperature at which crystallization of the amorphous alloy occurs on the shortest time scale, wherein said cooling happens at a rate sufficiently fast to avoid crystallization of the amorphous alloy;

stabilizing the temperature of the amorphous alloy within the intermediate thermoplastic forming temperature range;

shaping the amorphous alloy under a shaping pressure low enough to maintain the amorphous alloy in a Newtonian viscous flow regime and within the intermediate thermoplastic forming temperature for a period of time sufficiently short to avoid crystalization of the amorphous alloy to form a molded part; and cooling the molded part to ambient temperature.

2. The method as described in claim 1, wherein the intermediate thermoplastic forming temperature is sufficiently high to avoid melt flow instabilities in the cooled alloy.

3. The method as described in claim 1, wherein the shaping pressure is from about 1 to about 100 MPa.

4. The method as described in claim 1, wherein a heated shaping apparatus is selected from the group consisting of a mould, a die tool, a closed die, and an open-cavity die.

5. The method as described in claim 4, wherein the heated shaping apparatus is kept at a temperature within about 150° C. of the glass transition temperature of the amorphous alloy.

6. The method as described in claim 4, wherein the heated shaping apparatus is kept at a temperature within about 50° C. of the glass transition temperature of the amorphous alloy.

7. The method as described in claim 4, wherein the temperature of the heated shaping apparatus is controlled through a temperature feedback controller.

8. The method as described in claim 4, wherein the temperature of the heated shaping apparatus is increased during the forming step.

9. The method as described in claim 4, wherein the amorphous alloy is maintained in the heated shaping apparatus for a time suitable for the amorphous alloy to reach a nearly uniform temperature substantially equal to that of the heated shaping apparatus.

10. The method as described in claim 4, wherein the amorphous alloy is introduced into the heated shaping apparatus at a specified flow rate, and wherein the rate of flow of liquid alloy through the heated shaping apparatus is maintained at one of either a constant velocity or a constant strain rate.

11. The method as described in claim 10, wherein the strain rate is between about 0.1 and 100 $s^{-1}$.

12. The method as described in claim 4, wherein an applied pressure is used to move the amorphous alloy through the heated shaping apparatus.

13. The method as described in claim 12, wherein the applied pressure is less than about 100 Epa.

14. The method as described in claim 12, wherein the applied pressure is less than about 10 EPa.

15. The method as described in claim 1, wherein the shaping step takes about 10 to 100 times longer than the cooling step.

16. The method as described in claim 1, wherein the shaping step takes about 5 to 15 times longer than the cooling step.

17. The method as described in claim 1, wherein the shaping time is between about 3 and 200 seconds.

18. The method as described in claim 1, wherein the shaping time is between about 10 and 100 seconds.

19. The method as described in claim 1, wherein the shaping pressure is about 5 to 15 times more than the pressure applied to the molten amorphous alloy in the cooling step.

20. The method as described in claim 1, wherein the shaping pressure is about 10 to 100 times more than the pressure applied to the molten amorphous alloy in the cooling step.

21. The method as described in claim 1, wherein the shaping pressure is about 50 to 500 times more than the pressure applied to the molten amorphous alloy in the cooling step.

22. The method as described in claim 1, wherein the step of shaping the amorphous alloy further comprises extracting the molded part continuously.

23. The method as described in claim 1, wherein the amorphous alloy is a Zr—Ti alloy, where the sum of the Ti and Zr content is at least about 20 atomic percent of the composition of the amorphous alloy.

24. The method as described in claim 1, wherein the amorphous alloy is a Zr—Ti—Nb—Ni—Cu—He alloy, where sum of the Ti and Zr content is at least about 40 atomic percent of the composition of amorphous alloy.

25. The method as described in claim 1, wherein the amorphous alloy is a Zr—Ti—Nb—Ni—Cu—Al alloy, where sum of the Ti and Zr content is at least about 40 atomic percent of the composition of the amorphous alloy.

26. The method as described in claim 1, wherein the amorphous alloy is an Fe-base alloy, where the Fe content is at least about 40 atomic percent of the composition of the amorphous alloy.

27. The method as described in claim 1, wherein the amorphous alloy may be described in general terms by the formula $(Zr,Ti)_a(Ni,Cu, Fe)_b(Be,Al,si,B)_c$, where a is in the range of from about 30% to 75% of the total composition in atomic percentage, b is in the range of from about 5% to 60% of the total composition in atomic percentage, and c is in the range of from about 0% to 50% in total composition in atomic percentage.

28. The method as described in claim 1, wherein the amorphous alloy is $Zr_{47}Ti_8Ni_{10}cu_{7.5}Be_{27.5}$.

29. The method as described in claim 1, wherein the amorphous alloy has a supercooled liquid region (ΔTsc) of about 30° C. or more, where ΔTsc is defined as the difference of the onset of crystallization of the amorphous alloy ($T_x$) and the onset of glass transition of the amorphous alloy ($T_g$), as determined from standard differential scanning calorimetry scans at 20° C./min.

30. The method as described in claim 29, wherein the supercooled liquid region (ΔTsc) is about 60° C. or more.

31. The method as described in claim 29, wherein the supercooled liquid region (ΔTsc) is about 90° C. or more.

32. The method as described in claim 1, wherein the amorphous alloy has a critical cooling rate of about 1,000° C./sec or less.

33. A method of thermoplastically casting an amorphous alloy comprising the steps of:

providing a quantity of an amorphous alloy at a melt temperature above the melting temperature of the amorphous alloy.

pouring the amorphous alloy into a shaping apparatus at a flow rate and under a pressure to ensure Newtonian flow of the amorphous alloy, and simultaneously directly cooling said amorphous alloy to within an intermediate thermoplastic forming temperature range above the glass transition temperature of the amorphous alloy at a rate sufficiently fast to avoid crystallization of the amorphous alloy;

stabilizing the temperature of the amorphous alloy within the intermediate thermoplastic forming temperature range;

shaping the amorphous alloy to form a molded part, wherein the shaping occurs under a shaping pressure sufficiently low to avoid melt instabilities and wear on the shaping apparatus, within the intermediate thermoplastic forming temperature range for a period of time sufficiently short to avoid crystallization of the amorphous alloy; and cooling the molded part to ambient temperature.

* * * * *